US011911706B2

(12) United States Patent
Hicks

(10) Patent No.: US 11,911,706 B2
(45) Date of Patent: Feb. 27, 2024

(54) AUTOMATED RUNWAY LOOP FOR AERIAL PROJECTILE

(71) Applicant: Michael Joseph Hicks, Weaverville, NC (US)

(72) Inventor: Michael Joseph Hicks, Weaverville, NC (US)

( * ) Notice: Subject to any disclaimer, the term of this patent is extended or adjusted under 35 U.S.C. 154(b) by 331 days.

(21) Appl. No.: 17/328,304

(22) Filed: May 24, 2021

(65) Prior Publication Data

US 2021/0362038 A1 Nov. 25, 2021

Related U.S. Application Data

(60) Provisional application No. 63/029,528, filed on May 24, 2020.

(51) Int. Cl.

| | |
|---|---|
| ***A63F 7/00*** | (2006.01) |
| ***A63F 7/36*** | (2006.01) |
| ***A63H 11/08*** | (2006.01) |
| ***A63H 18/00*** | (2006.01) |
| *A63B 67/08* | (2019.01) |

(52) U.S. Cl.

CPC ..... *A63F 7/0058* (2013.01); *A63F 7/3622* (2013.01); *A63H 11/08* (2013.01); *A63H 18/00* (2013.01); *A63B 67/083* (2013.01); *A63F 2007/3637* (2013.01)

(58) Field of Classification Search

CPC ..... A63F 7/0058; A63F 7/3622; A63F 2007/3637; A63F 7/249; A63F 2009/2442; A63F 2009/2482; A63F 7/30; A63F 2007/3035; A63B 67/083; A63B 24/0062; A63B 71/0622; A63B 71/0669; A63B 2071/0663; A63B 2220/17; A63B 2220/40; A63H 18/00; A63H 11/08

USPC ..... 434/300

See application file for complete search history.

(56) References Cited

U.S. PATENT DOCUMENTS

| | | | | |
|---|---|---|---|---|
| 3,299,565 A * | 1/1967 | Yarashes | A63F 7/0088 | 104/68 |
| 4,537,401 A * | 8/1985 | Smith | A63F 7/382 | 273/112 |
| 5,855,501 A * | 1/1999 | Kato | A63F 7/3622 | 446/168 |
| 5,908,343 A * | 6/1999 | Rothbarth | A63F 7/3622 | 446/171 |
| 8,814,628 B2 * | 8/2014 | O'Connor | A63H 18/02 | 446/435 |

(Continued)

*Primary Examiner* — Michael C Grant

(74) *Attorney, Agent, or Firm* — The Van Winkle Law Firm; William G. Heedy

(57) ABSTRACT

An automated runway loop including a u-shaped runway, wherein the runway is configured to support an aerial projectile with the runway having a discharging end and a receiving end. The runway has a support attached to the runway and to a motor capable of extending and retracting the runway along an axis. At least one sensor is positioned along the runway and configured to provide at least one output indicative of at least one parameter of the aerial projectile. A computer is connected to the sensors and the motor, the computer controlling energization of the motor based at least in part on an indicated parameter of the aerial projectile, where the energization of the motor causes the aerial projectile to be discharged from one end of the runway and to be received at the other end of the runway.

20 Claims, 19 Drawing Sheets

(56) References Cited

U.S. PATENT DOCUMENTS

| | | | | |
|---|---|---|---|---|
| 2015/0079875 | A1* | 3/2015 | Flores | A63F 7/3622 446/431 |
| 2019/0160368 | A1* | 5/2019 | Campbell | A63C 19/10 |

* cited by examiner

AUTOMATED RUNWAY LOOP FOR AERIAL PROJECTILE

RELATED APPLICATION

This application claims priority to and incorporates entirely by reference U.S. Provisional Patent Application Ser. No. 63/029,528, filed May 24, 2020, entitled "An automated calibration device and data gather utilizing a U-shaped runway looping an ariel projectile." This application also incorporates entirely by reference U.S. Pat. No. 6,537,163, issued Mar. 25, 2003, entitled "Hand-Held Amusement Device."

FIELD OF THE INVENTION

This invention relates to an amusement device for continuous looping of an aerial projectile along a U-shaped runway, and more particularly, an intelligent, automated system including sensors, an automated stepper motor assembly, and computing means for monitoring and calibrating the system to achieve continuous looping.

This invention also relates to an interactive electronic training game that uses an aerial projectile and a tube-shaped conduit to encourage increased focus for users.

BACKGROUND OF THE INVENTION

While there are existing manual projectile looping systems which include improvements over the prior art and are useful for their intended purposes, these devices fail to provide an automated system for monitoring and calibrating continuous looping of the aerial projectile.

Therefore, there exists a need for an automated continuous looping system including a u-shaped runway, sensors, motion mechanism, and computing means for monitoring and calibrating the movement of an aerial projectile.

SUMMARY OF THE INVENTION

In accordance with one form of the present invention, there is provided an automated runway loop for an aerial projectile, the automated runway loop including a u-shaped runway, the runway having a bottom surface and a first end and a second end, the runway defining a path between the first end and the second end; the runway configured to support the aerial projectile, wherein the first end is configured for discharge of the aerial projectile and the second end is configured for receipt of the aerial projectile; a runway support attached to or integrally formed with the bottom surface of the runway; the runway support attached to or integrally formed with a motor, the motor capable of extending and retracting the runway support along an axis; at least one sensor positioned along the runway, the at least one sensor being configured to provide at least one output indicative of at least one parameter of the aerial projectile; a computer including a bus connected to a processor, an input device, a data storage device, an internal storage device, and an output device, wherein the computer is in operable communication with the motor and with the plurality of sensors; the computer being configured to control energization of the motor based at least in part on an indicated parameter of the aerial projectile; wherein the energization of the motor causes the aerial projectile to be discharged from the first end of the runway and to be received at the second end of the runway for continuous looping of the aerial projectile.

In accordance with one form of the present invention, there is provided an automated runway loop for an aerial projectile, the automated runway loop including a u-shaped runway, the runway having a bottom surface and a first end and a second end, the runway defining a path between the first end and the second end; the runway configured to support the aerial projectile, wherein the first end is configured for discharge of the aerial projectile and the second end is configured for receipt of the aerial projectile; a runway support attached to or integrally formed with the bottom surface of the runway; the runway support attached to or integrally formed with a motor, the motor capable of extending and retracting the runway support along an axis; at least one sensor positioned along the runway, the at least one sensor being configured to provide at least one output indicative of detection of the aerial projectile; a computer including a bus connected to a processor, an input device, a data storage device, an internal storage device, and an output device, wherein the computer is in operable communication with the motor and with the plurality of sensors; the computer being configured to control energization of the motor based on a time delay triggered by the detection of the aerial projectile, wherein the energization of the motor causes the aerial projectile to be discharged from the first end of the runway and to be received at the second end of the runway for continuous looping of the aerial projectile.

In accordance with one form of the present invention, there is provided a method of looping an aerial projectile on an automated runway loop, the runway loop having a first end and a second end and a bottom and sensors and configured for receiving the aerial projectile, the bottom mounted to a motor for applying force to the bottom, the method including receiving the aerial projectile at the second end of the runway loop; sensing a parameter of the aerial projectile; driving the runway loop, with the motor, with a force sufficient to discharge the aerial projectile from the first end and to receive the aerial projectile at the second end in response to the sensed parameter.

BRIEF DESCRIPTION OF THE DRAWINGS

For a fuller understanding of the nature of the present invention, reference should be made to the following detailed description, taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the automated runway loop of the present invention is shown and described herein and is generally indicated as 100.

Figure 1:
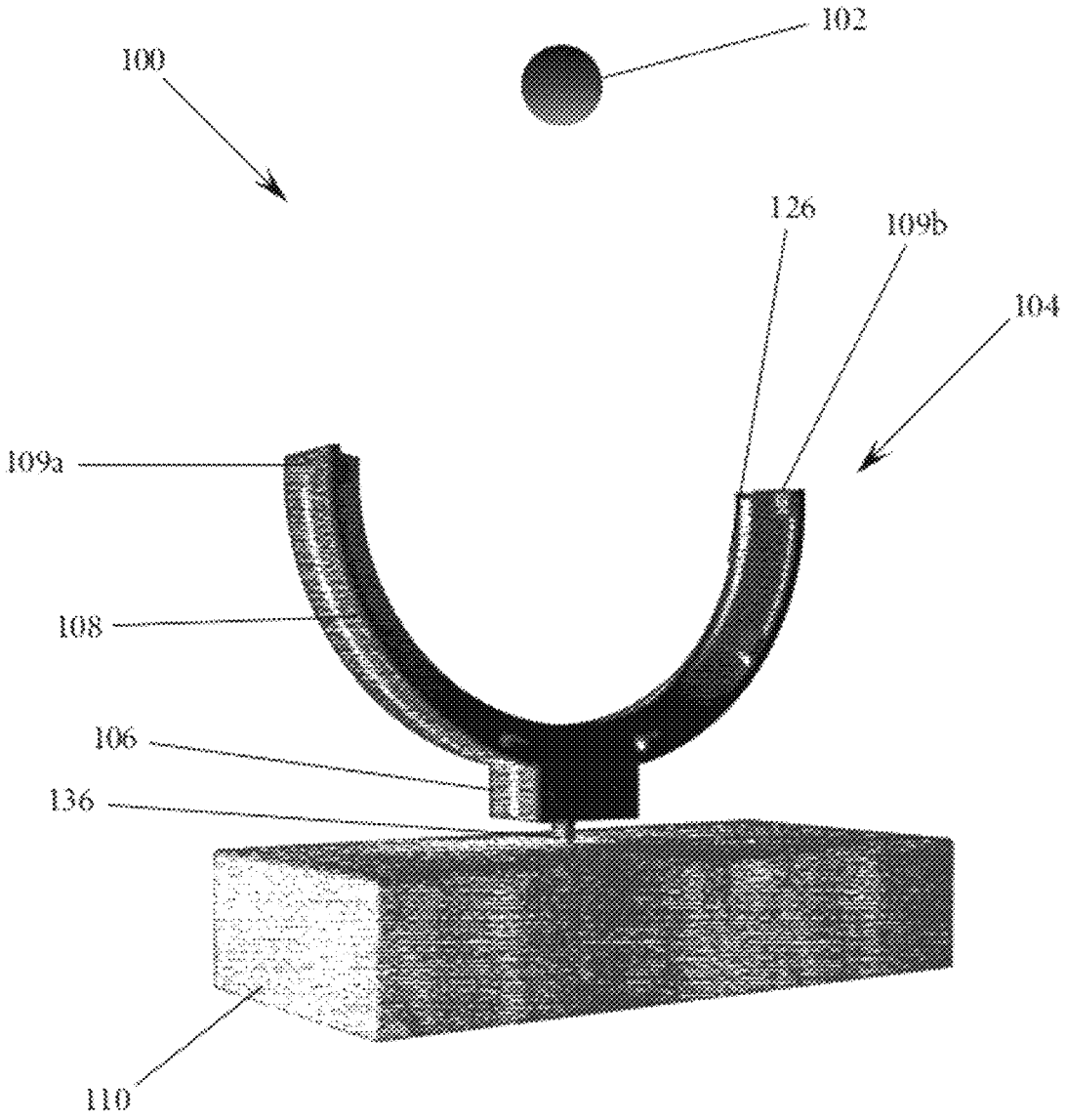
FIG. 1 is a perspective view of an automated runway loop for aerial projectile in accordance with one embodiment.
Figure 8:
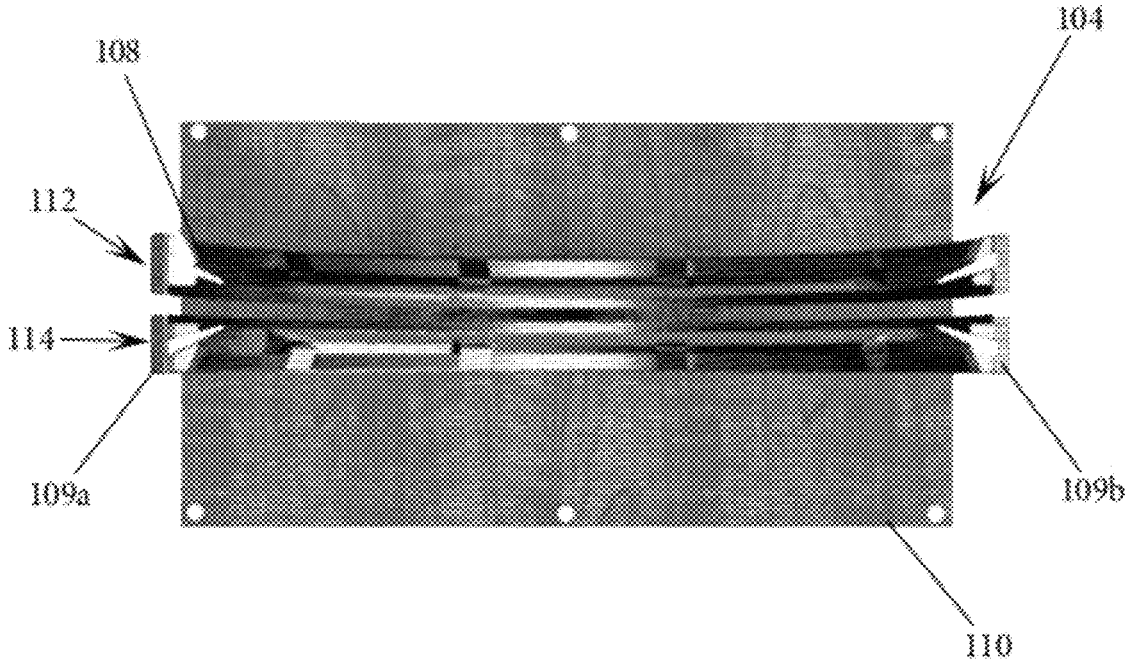
FIG. 8 is a top view of an automated runway loop for aerial projectile in accordance with one embodiment.
Figure 9:
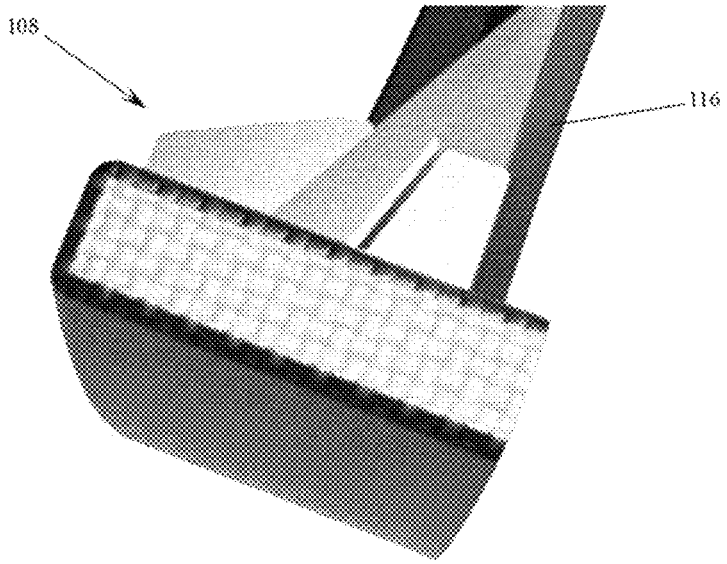
FIG. 9 is an isolated top view of a runway rail in accordance with one embodiment.

Referring initially to FIGS. 1 and 8, the automated runway loop 100 includes a runway 104 including the runway rail 108 and runway base support 106 located beneath the runway rail 108. The runway 104 may have opposing ramp sections wherein a discharging ramp section 109*b* discharges the aerial projectile 102 vertically from the runway rail 108 and receiving ramp section 109*a* receives the aerial projectile 102 after it is discharged from discharging ramp section 109*a* during a continuous looping of the automated runway loop 100. The runway base support 106 is attached to a mounting shaft 136 that is attached to or integrally formed with one or more motors, which may be concealed within enclosure base 110. Alternatively, the runway rail 108 may be directly attached to or integrally formed with a runway support in the form of a mounting shaft 136 connecting the runway rail 108 to a motor.

The invention also includes a spherically shaped aerial projectile 102 for use in the automated runway loop 100.

Referring now to FIGS. 3-9, in one embodiment the runway rail 108 is a u-shaped apparatus comprised of two mating components, wherein a first knife-edge ridge component 112 is selectively attached to a second knife-edge ridge component 114 via a knife-edge rail connector 188. The knife-edge rail connector 188 may be comprised of a male connector 120 and female receiver 122, wherein the female receiver 122 contains apertures sizably configured for receipt of male connector 120 for frictional attachment of first knife-edge ridge component 112 to second knife-edge ridge component 114. In alternative embodiments, attachment may be by means of a motor assembly, wherein a motor assembly may be attached to separation screws between the first knife-edge ridge component 112 and second knife-edge ridge component 114 to increase or decrease the distance between the first knife-edge ridge component 112 and second knife-edge ridge component 114. Use of such a motor may allow the runway 104 to be sized for receipt of differently sized aerial projectiles 102 or to allow the aerial projectile 102 to be inserted and/or removed from the runway rail 108 via the aerial projectile 102 passing between the first knife-edge ridge component 112 and second knife-edge ridge component 114, when such components are appropriately distanced to allow the aerial projectile 102 to pass therethrough.

Each of the first knife-edge ridge component 112 and second knife-edge ridge component 114 are comprised of an outer surface 124 and a knife-edge rail 116 located along the inner runway surface 126, wherein the two opposing knife-edge rails 116 provide at least two points of contact for supporting the aerial projectile 102 when aerial projectile 102 is in contact with the interior runway surface 126 of the u-shaped runway rail 108.

In one embodiment the knife-edge rail 116 may be of a width substantially smaller than that of the outer surface 124, which is preferable for reducing friction between the aerial projectile 102 and the knife-edge rails 116, thus requiring less lifting energy to discharge the aerial projectile 102 from the runway rail 108. In one embodiment, the knife-edge rail 116 may be composed of a hardened steel, hardened plastic, carbon fiber, wood, or similar metal and/or polymer. The knife-edge rails 116 may also be mounted with dampening grommets 142 to reduce vibration and increase stability in the runway rail 108. As discussed elsewhere, the use of two separate knife-edge rail 116 components allows the knife edge rails 116 to separate or open for receiving or being resized to receive the aerial projectile 102.

In one embodiment, the enclosure base 110 encloses the electromechanical operations that operate the automated runway loop 100, as described further in the specification. Similarly, the mounting shaft 136 may be hollow so that wires can be concealed in passage from the enclosure base 110 through the mounting shaft 136 to the runway 104. The runway 104 and/or runway rails 108 may also be hollow to allow for sensors to be mounted interior to these components to permit monitoring of the aerial projectile's location, velocity, acceleration, and movement along the runway 104.

Figure 18:
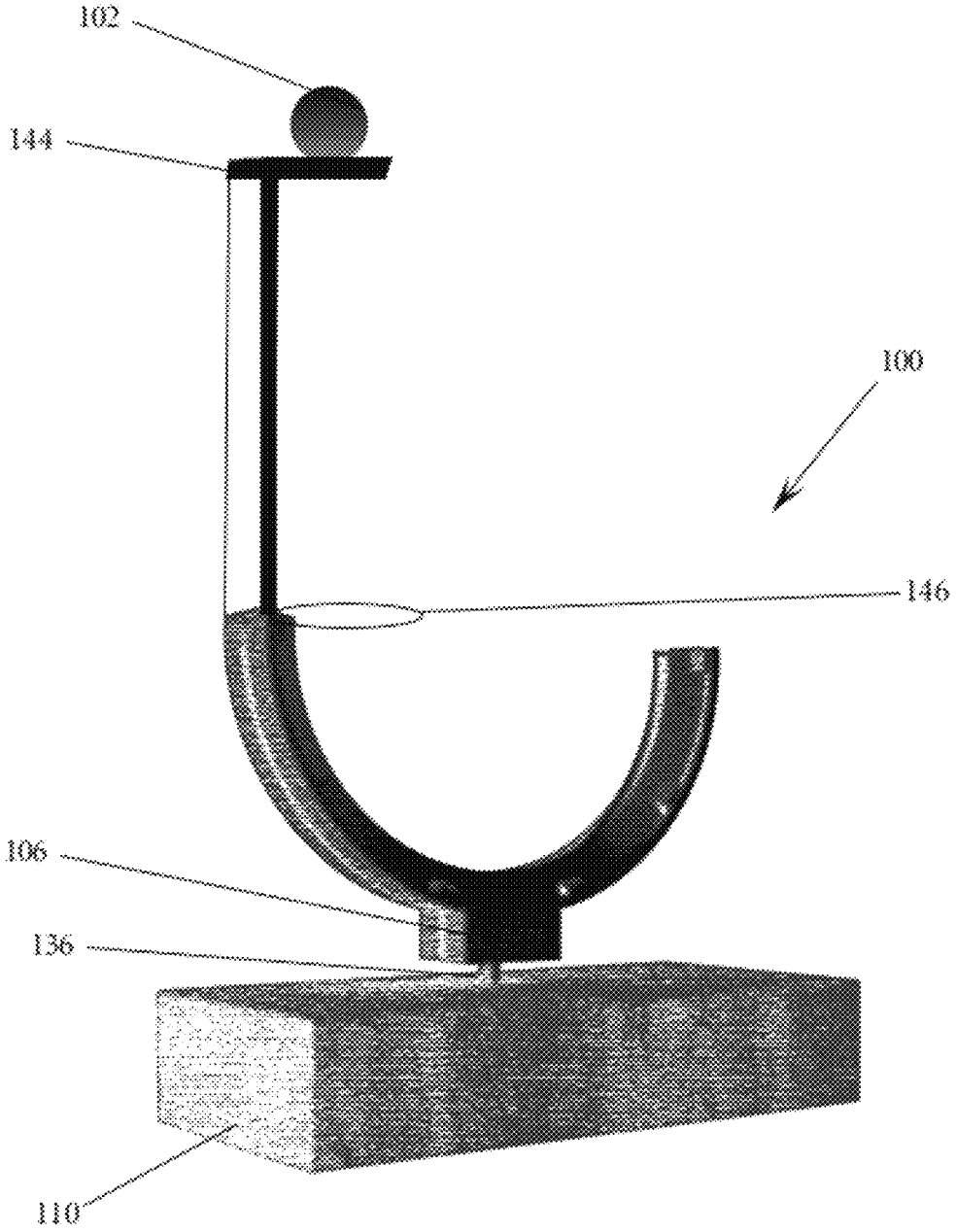
FIG. 18 is a perspective view of an automated runway loop in accordance with one embodiment.

Referring now to FIG. 18, in one embodiment, the aerial projectile 102 may be positioned atop a launch platform 144 located above one end of the runway rails 108. The aerial projectile 102 may be dropped from the launch platform 144 onto the runway rails 108 via mechanical means or via manual means. For example, the launch platform 144 may include a hole with a removable pin atop which the aerial projectile 102 may rest. Once the pin is removed from the hole, the aerial projectile 102 is released downward onto the runway rails 108. Alternatively, for example, an electromechanical motor may function to rotate the launch platform 144 about an axis, releasing the aerial projectile 102 onto the runway rails 108.

A plurality of eye sensors 146 are located on the runway rails 108. The eye sensors 146 are capable of detecting the passing or presence of the aerial projectile 102 as it moves along the runway rail 108, and may also detect the velocity or acceleration of the aerial projectile 102 as it moves along the runway rail 108.

Figure 15:
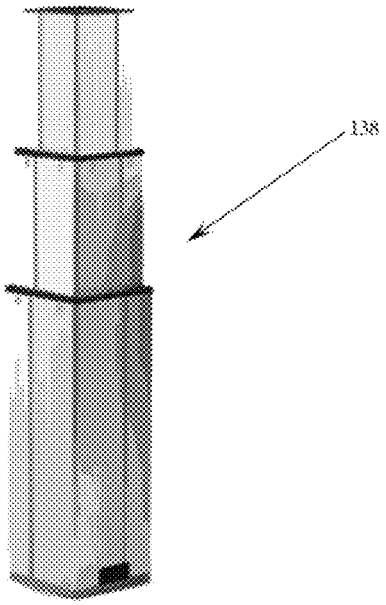
FIG. 15 is a perspective view of a linear lift actuator in accordance with one embodiment.
Figure 16:
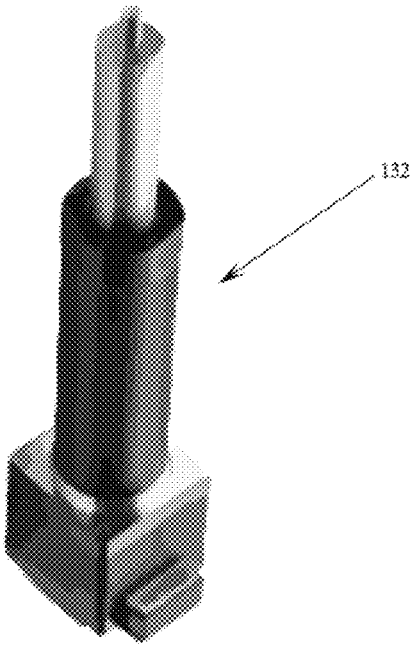
FIG. 16 is a perspective view of a telescopic lift actuator in accordance with one embodiment.

In one embodiment, as the aerial projectile 102 drops from the launch platform 144, it passes through an eye sensor 146, which sends a signal to the computer 148 to begin the looping process. In the looping process, the computer 148 controls the lifting and acceleration of a motor, such as a stepper motor 148, telescopic lift actuator 132 (FIG. 16), linear lift actuator 138 (FIG. 15), or vertical actuator 140. Specifically, the plurality of eye sensors 146 in combination with the computer 148 may calculate the speed and/or acceleration of the aerial projectile 102 as it passes between the plurality of eye sensors 146. The speed and acceleration data allow the computer 148 to control the motor for providing the appropriate lift and acceleration to cause the aerial projectile 102 to leave the discharging ramp section 109*b* of the runway rail 108, to pass through the air, and to be received by the receiving ramp section 109*a* of the runway rail 108.

Figure 12:
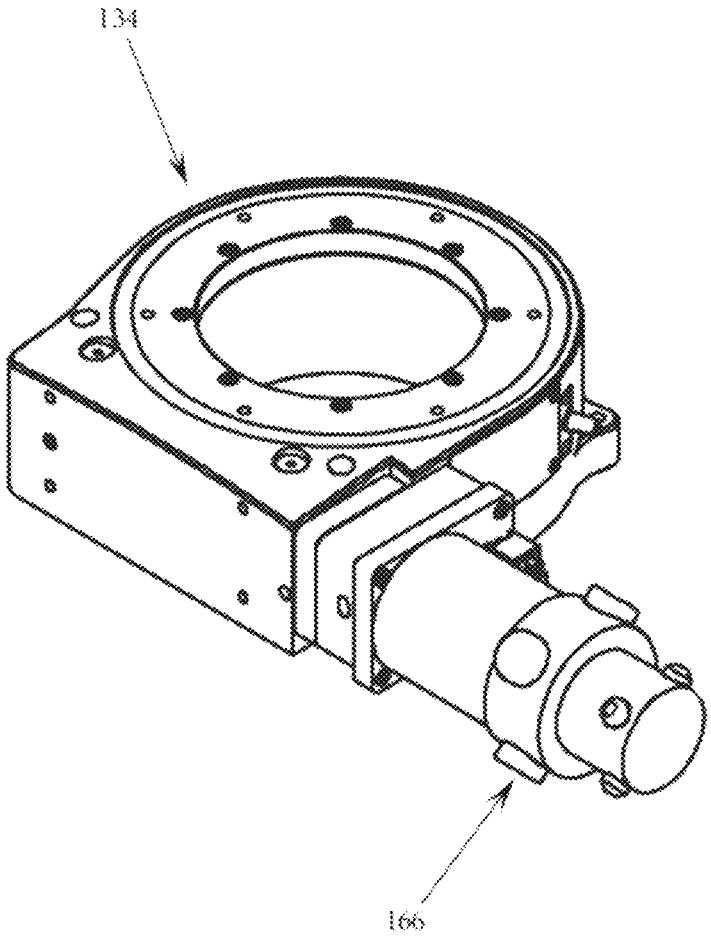
FIG. 12 is an isometric view of a rotation actuator in accordance with one embodiment.

In one embodiment a plurality of motors are configured to operate on an x-axis, a y-axis, and a z-axis. Similarly, one or more of the plurality of stepper motors are connected to a rotation actuator 134 (FIG. 12), allowing the runway 104 to move horizontally along a y-axis or an x-axis and vertically along a z-axis and to rotate around a central axis. Moving along these multiple axes, a user is able to customize the manipulation of the runway 104 for the looping process.

In one embodiment, a plurality of motors and rotation actuators 134 may be connected to the runway base 106 or mounting shaft 136, allowing the runway 104 to be moved along multiple axes and to be rotated around one or more points. In this embodiment, the aerial projectile 102 may begin at rest on the runway rails 108. The motors and rotation actuators 134 may rotate the runway 104 along a central point while moving the runway back and forth along an axis to begin rocking the aerial projectile 102 along the runway rails 108. A plurality of eye sensors 146 located along the runway 104 measure the velocity of the aerial projectile 102, and once the computer 148 determines that the aerial projectile 102 has reached sufficient velocity, a motor may begin lifting the runway 104 along a vertical axis with a force sufficient to discharge the aerial projectile 102 from the discharging ramp section 109*b* and to receive the aerial projectile 102 at the receiving ramp section 109*a*.

Figure 19:
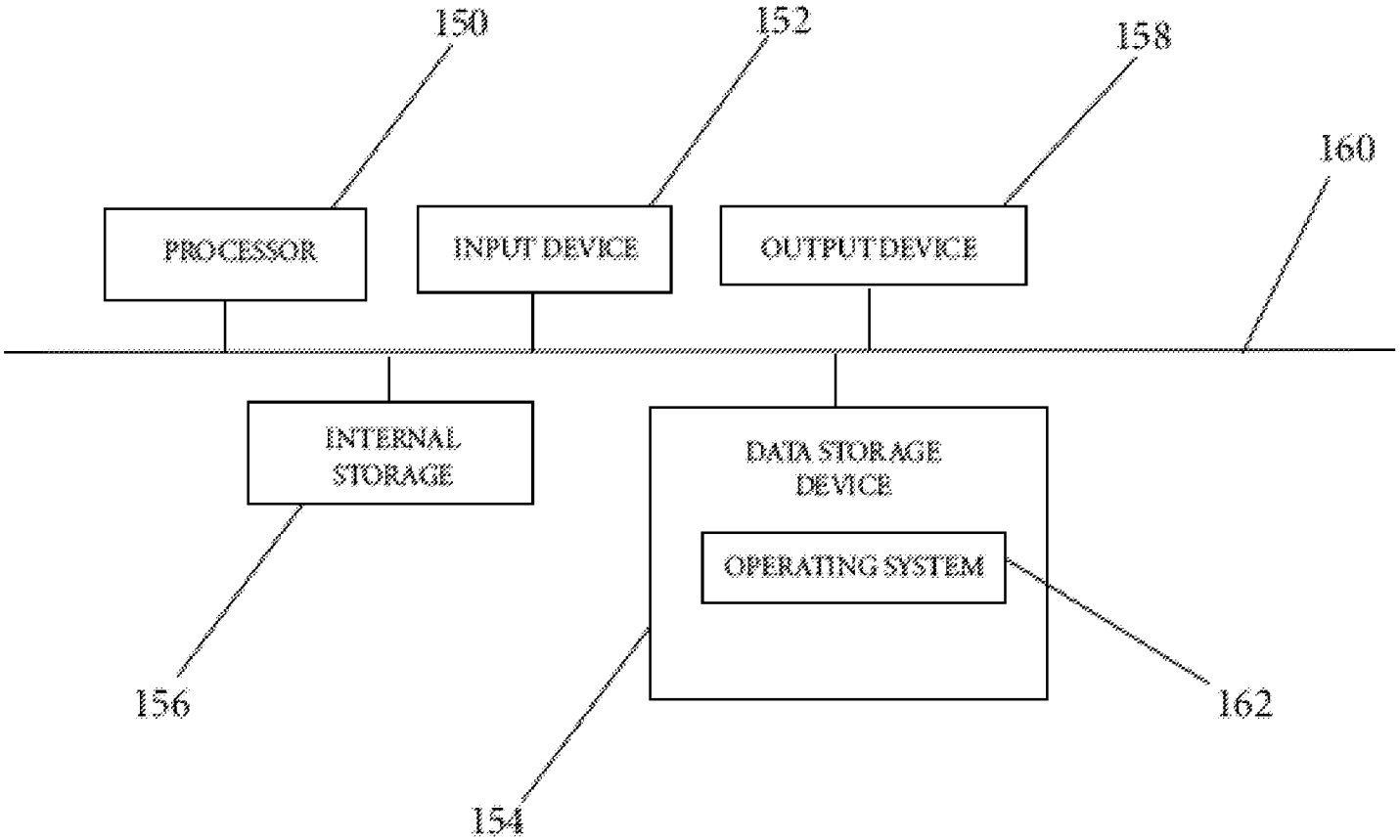
FIG. 19 is a block diagram illustrating details of a computer in accordance with one embodiment.

Referring now to FIG. 19, in one embodiment, the computer 148 may include a processor 150, an input device 152, a data storage device 154 such as a solid state, flash, or magnetic memory device, internal storage 156 such as Random-Access Memory (RAM), and an output device 158, each connected to a bus 160. An operating system 162 controls processing by the processor 150 and is generally stored in the data storage device 154 and loaded into internal storage 156 for execution by processor 150. A person of ordinary skill in the art will appreciate that the computer 148 may also include additional or alternative components without departing from the spirit or objective of the invention.

Figure 14:
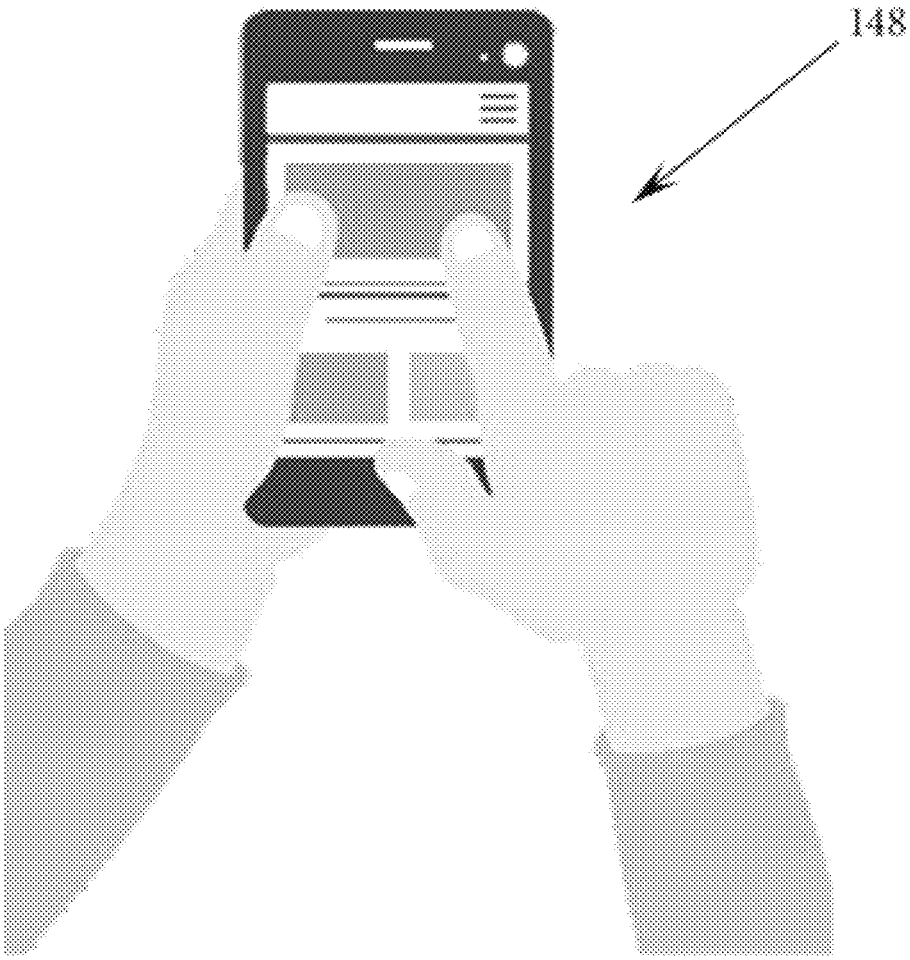
FIG. 14 is a view of a computer in accordance with one embodiment.

Similarly, and as depicted in FIG. 14, according to one embodiment the computer may comprise a smartphone, tablet, or similar device having a processor, input device, data storage device, internal storage, output device, each connected to a bus. Such smartphone, tablet, or similar device may be connected to automated runway loop 100 via Bluetooth or similar wireless protocol, via tethered data cable, or via similar data connection system.

Figure 17:
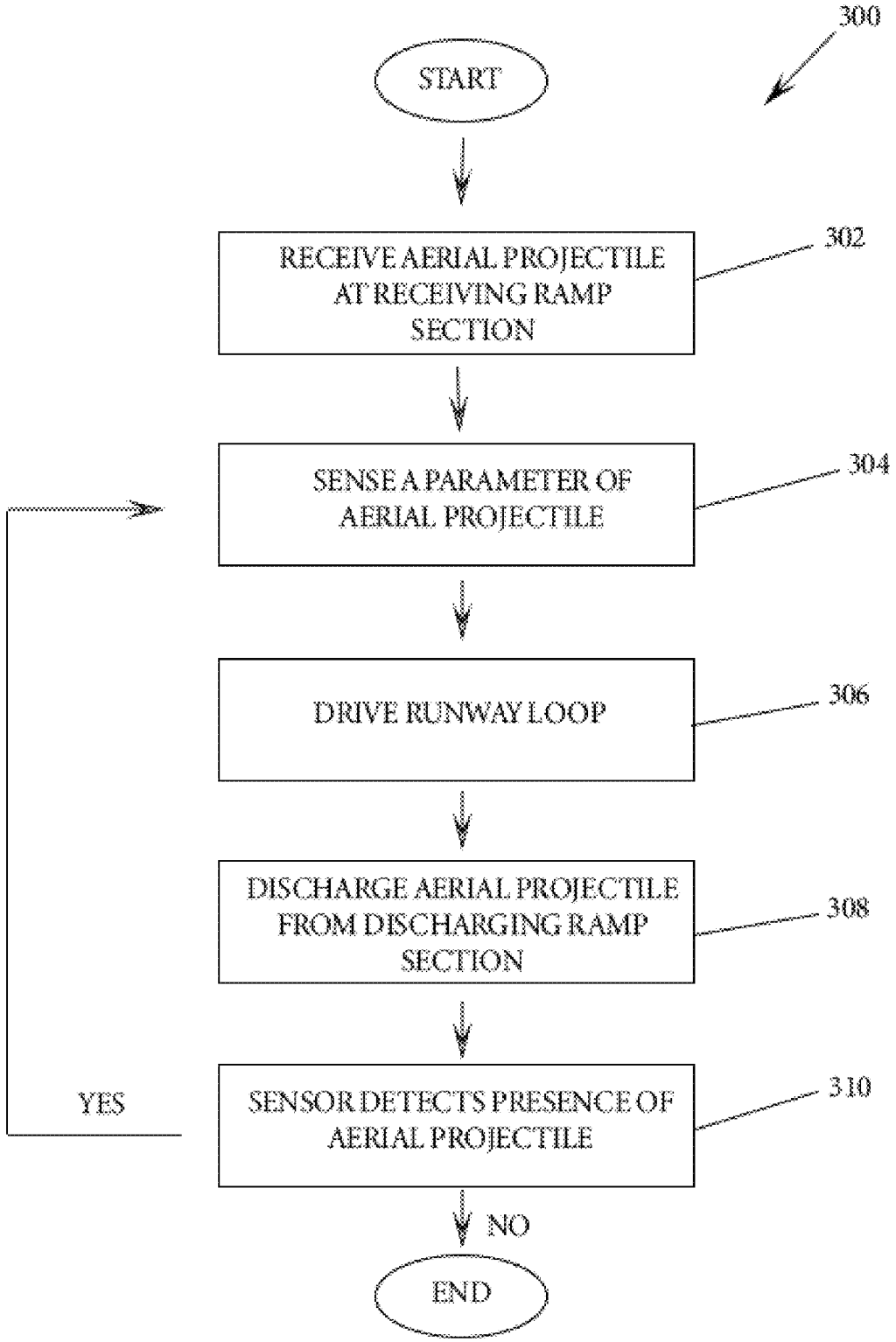
FIG. 17 is a flow chart diagram illustrating details of a continuous looping process in accordance with one embodiment.

Referring now to FIG. 17, a flowchart illustrating a method 300 of looping an aerial projectile 102 on an automated runway loop 100 is disclosed for use with a runway 104 having a receiving ramp section 109*a* and a discharging ramp section 109*b* and a runway base support 106 and/or mounting shaft 136 and configured for receiving the aerial projectile 102, the bottom of the runway mounted to a one or more motors for applying force to the runway 104 along one or more axes.

The method 300 begins in step 302 with the user directly or indirectly depositing the aerial projectile 102 into the receiving ramp section 109*a* of the runway 104. In step 304, one or more eye sensors 146 may detect parameters of the aerial projectile 102, such as the presence, position, velocity, and/or acceleration of the aerial projectile 102 as it passes along the runway 104. In step 306, a computer 148 then utilizes the parameters in step 304 to drive the motor of the runway 104, with a force sufficient to discharge the aerial projectile 102 in step 308 from the discharging ramp section 109*b* and to receive the aerial projectile 102 at the receiving ramp section 109*a*.

The eye sensor 146 in step 310 determines whether the aerial projectile 102 has been received again at the receiving ramp section 109*a*, and thus continues operation in a continuous loop.

Figure 10:
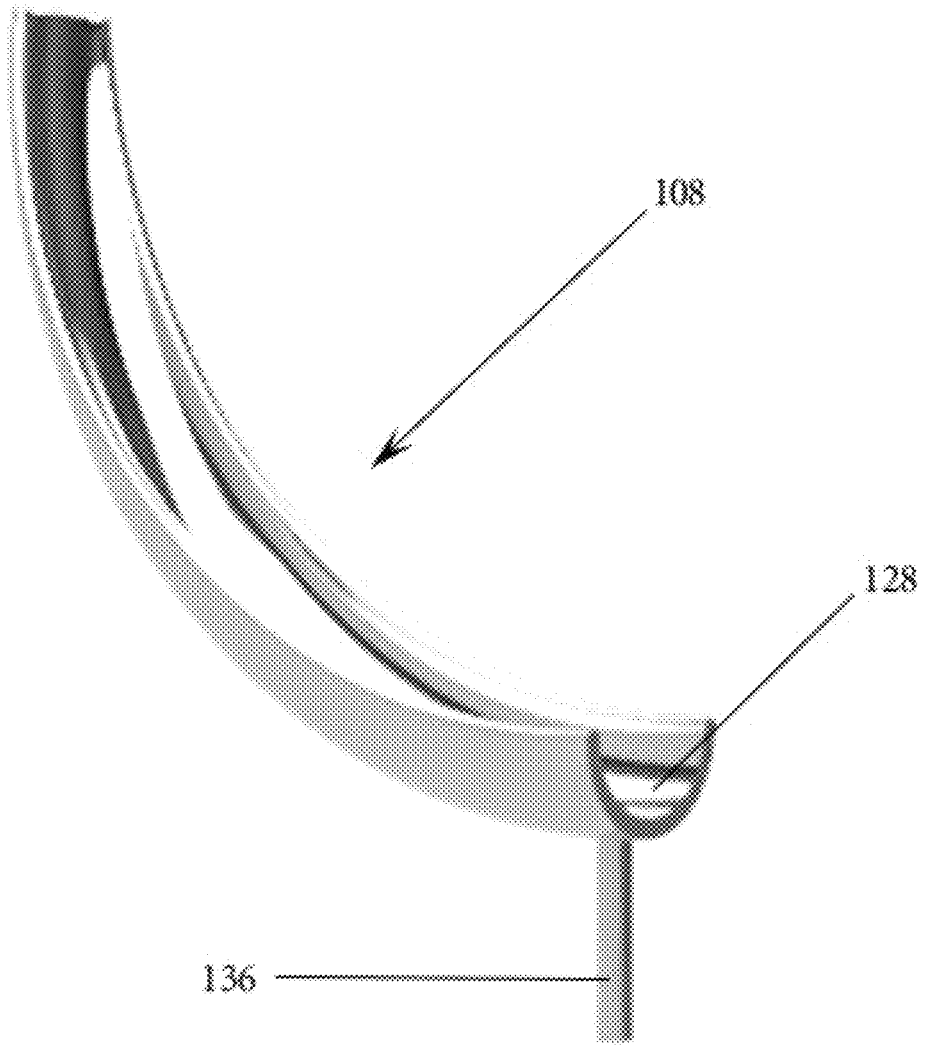
FIG. 10 is a perspective view of a runway shown in cross section in accordance with one embodiment.
Figure 11:
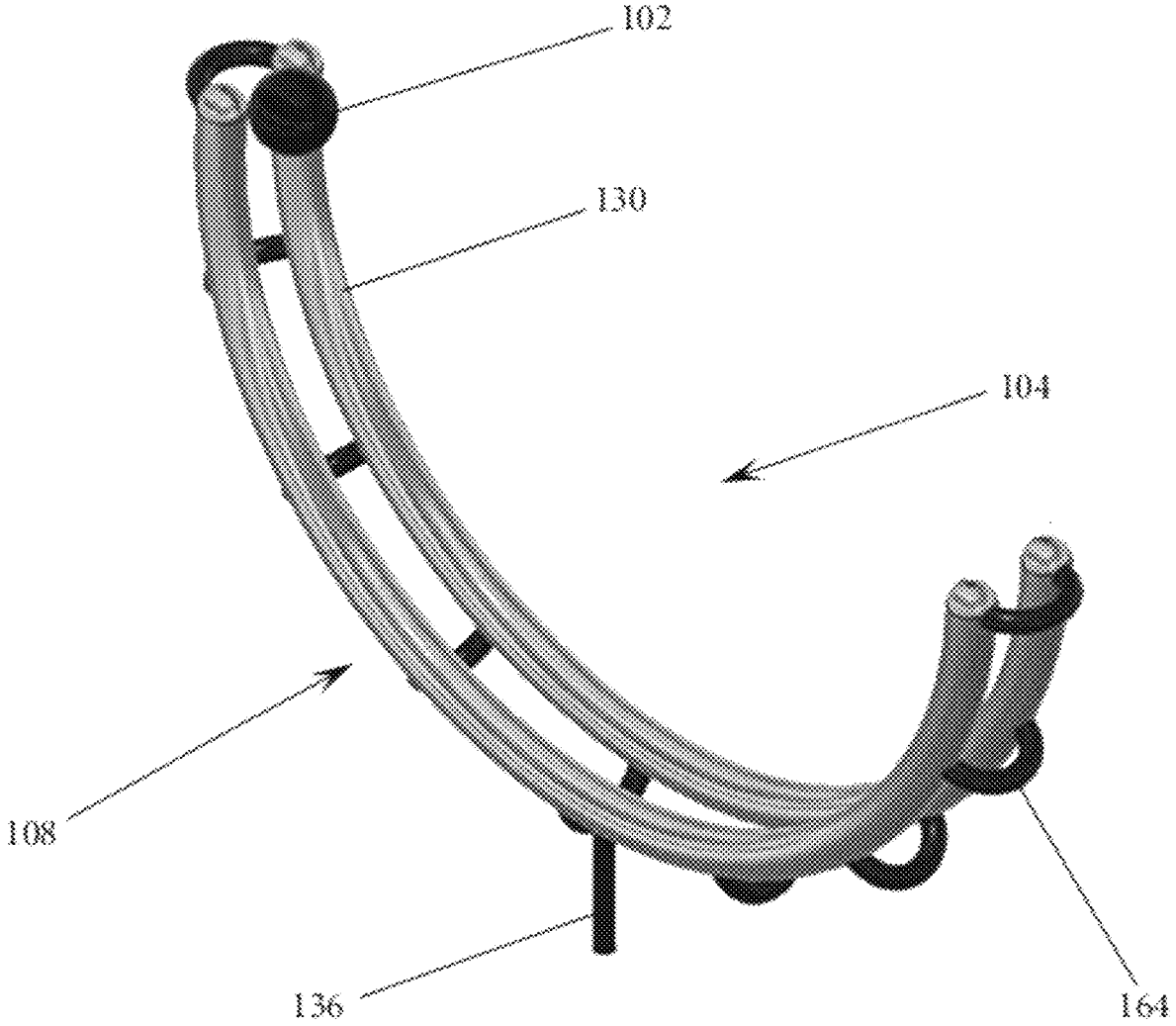
FIG. 11 of a perspective view of a runway in accordance with one embodiment.

Referring now to FIG. 10, in alternative embodiments, the runway 108 may be comprised of a single concave channel 128 comprised of a hard plastic or metal material, wherein the concave channel 128 is sized to permit the aerial projectile 102 to roll along the concave channel 128. Referring now to FIG. 11, in an alternative embodiment, the runway rail 108 may be comprised of two parallel rounded rails 130 distanced sufficient to allow the aerial projectile 102 to rest therebetween. Rounded rails 130 may be secured to one another via rounded rail connectors 164 located along the external side of the runway rail 108. It will be appreciated by one of ordinary skill that the channel or rounded rails of the runway 108 may be of different depths, widths, and/or heights without departing from the spirit, goals, and function of the invention.

According to one embodiment, the aerial projectile 102 may be constructed of hardened steel, plastic, or a phenolic composition.

In one embodiment, the aerial projectile 102 is lifted from an opening in the enclosure base 110 by means of a telescopic lift actuator 132. The opening may be covered by a door that is opened and closed by use of an actuator motor. An actuator motor assembly located within runway base support 106 moves the knife-edge rails 116 sufficiently apart to permit the aerial projectile 102 to be lifted between the knife-edge rails 116 until the aerial projectile 102 is above the knife-edge rails 116. The actuator motor assembly within runway base support 106 may then move the knife-edge rails 116 into sufficient proximity to allow the knife-edge rails 116 to support the aerial projectile 102. The telescopic lift actuator 132 may then retract into the opening of the runway base support 106.

In one embodiment, a rotation actuator 134 is located beneath runway rail 108 and attached to the runway base support 106 to adjust and move the runway rail 108. When the aerial projectile 102 is at rest atop the knife-edge rails 116, the rotation actuator 134 may adjust the launch degree toe-in for the initial launch, which is determined by the distance between receiving ramp section 109*a* and discharging ramp section 109*b*. A linear lift actuator 138 may also be attached to both the runway rail 108 and to the rotation actuator 134 to provide for automatic adjustment of the toe-in. This toe-in adjustment will permit operation of continuous looping and the ability to adjust the height of the ball launched while in continuous loop mode.

Figure 13:
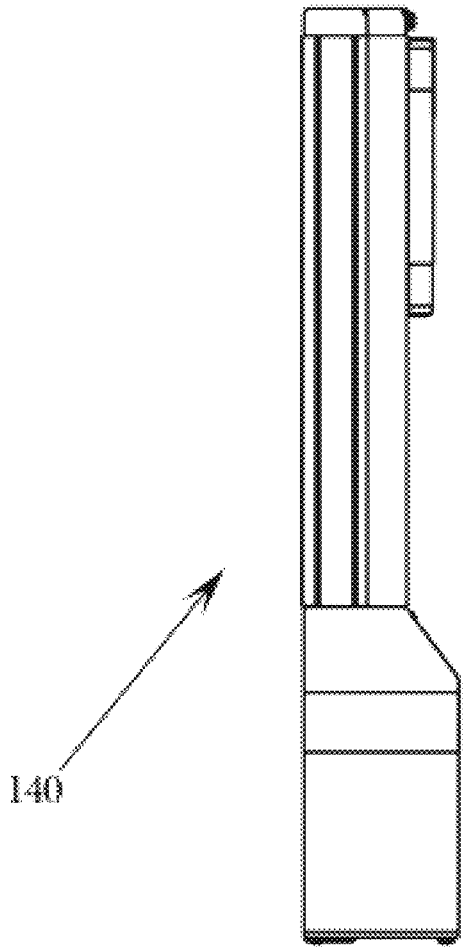
FIG. 13 is a profile view of a vertical actuator in accordance with one embodiment.

In one embodiment, the preferred toe-in for the runway rail 108 and inner runway surface 126 is in the range of about one degree or less to about three degrees or more of toe-in angle between the upper portion of receiving ramp section 109*a* and discharging ramp section 109*b*. The toe-in degree depends on the desired launch height for the aerial projectile 102, wherein a higher ball launch requires less toe-in angle. The toe-in may also be adjusted using leveling feet attached to the automated runway loop 100 at, for example, the enclosure base 110 or runway 104. Alternatively, the toe-in may be adjusted by rotation of the rotation actuator 134, linear lift actuator 138, or vertical actuator 140 (FIG. 13) along the runway 104.

After the correct toe-in angle has been achieved, the aerial projectile 102 may be placed at rest at the lowermost point of the runway rail 108. To begin the launch of aerial projectile 102, the vertical actuator 140 will move along one axis to roll the aerial projectile 102 as sensors monitor its location along the runway rail 108 to provide data to permit the automated runway loop 100 to properly instruct the vertical actuator 140 as to the appropriate time to reverse direction to roll the aerial projective 102 in the reverse direction.

As the aerial projectile 102 reaches the apex of motion and begins to roll back down, the lift actuator 140 extends upwards along the z-axis at a sufficient velocity to discharge the aerial projectile 102 from the runway 104. As the aerial projectile 102 is reenters the receiving ramp section 109*a*, sensors located in the runway 104 and/or enclosure base 110 monitors the aerial projectile's 102 velocity to calculate the duration of aerial projectile's 102 time in flight between discharging ramp section 109*b* and receiving ramp section 109*a*. The duration may be used to determine the launch height to accurately calculate the vertical actuator's 140 upward force, which allows a continued smooth operation for continuously looping the aerial projectile 102. Once the launch is initialized and the aerial projectile 102 is looping at a steady frequency, the toe-in angle can be increased or decreased as needed to allow continued looping of the aerial projectile on the runway 104.

In one embodiment, the method of terminating the continuous looping begins at a point when the aerial projectile 102 makes contact with the receiving ramp section 109*a*. Once contact is made, the linear lift actuator 138 descends to recapture the aerial projectile 102 and zeroes the toe-in so the aerial projectile 102 launches vertically and descends back to the same side of the runway 104. As the aerial projectile 102 makes contact, the linear lift actuator 138 again descends and moves along an x- and y-axis in a vector that is opposite of that to the aerial projectile's 102 movement to assist in decelerating the aerial projectile's 102 movement. Once the aerial projectile 102 is at rest, a telescopic lift actuator 132 extends upwards from an opening in the enclosure base 110 until it makes contact with the aerial projectile 102. An actuator motor assembly within the runway base support 106 increases the distance between the first knife-edge rail component 112 and second knife-edge rail component 114, permitting the telescopic lift actuator 132 to descend, returning the aerial projectile 102 within the enclosure base 110.

In one embodiment, the launch is automated utilizing a telescopic lift actuator 132 extending from a sliding opening in the enclosure base 110. The telescopic lift actuator 132 extends vertically until it reaches a position above the runway 104, at which point a linear actuator extends the ball over the runway 104 and then drops the aerial projectile 102. The linear actuator retracts and the telescopic lift actuator 132 retracts into the enclosure base 110. This embodiment requires only lifting action along the vertical access to maintain a continuous looping. However, a specific toe-in angle may be required, or alternatively, a rotational axis is required to simulate a toe-in, allowing a calibration of these factors for a specific launch height and looping movement.

In one embodiment, launching of the aerial projectile 102 can be achieved by utilizing multiple axes to launch the aerial projectile 102 from a position at rest on the lower section of the runway rail 108. The linear lift actuator 138 moves in one direction to roll the aerial projectile 102 as sensors monitor the aerial projectile's 102 location along the runway rail 108 and directing a reverse of the vertical movement to move the aerial projectile 102 up the opposite side of the runway rail 108. This vertical movement allows the aerial projectile 102 to reach the peak of one side of the runway rail 108, then initiate the linear lift actuator 138 along the z-axis to launch the aerial projectile 102. This embodiment may not allow for looping multiple arial projectiles at once.

In connection with this embodiment, a processing unit and/or computer with timer begins a count until the aerial projectile 102 reaches the spot at which the processing unit and/or computer activates the linear lift actuator 138 to extend in order to launch the ball out of the discharging ramp section 109*b* for receipt by the receiving ramp section 109*a* to begin the continuous looping process.

In one embodiment, the enclosure base 110, mounting shaft 136, and/or runway base support 106 may have actuators that move along an x-axis and a y-axis to rock the aerial projectile 102 back and forth along the runway rail 108. When the aerial projectile 102 reaches the appropriate height, the linear lift actuator 138 extends along a vertical z-axis to lift the runway 104 to begin the launch sequence of the aerial projectile 102 out of the discharging ramp section 109*b* for receipt by the receiving ramp section 109*a*.

In one embodiment, a 3 to 4 axis robotic arm may extend from the enclosure base 110 grasping the aerial projectile 102. The arm may move itself into position to above the runway 104 in order to drop the aerial projectile 102 onto the receiving ramp section 109*a* of the runway 104. After the aerial projectile 102 is dropped, the automated runway loop 100 begins the continuous looping procedure set forth in the embodiments discussed elsewhere in the specification.

In this embodiment a door could be attached to the robotic arm so the arm folds into the enclosure base 110 in a way that allows for the door to be level with the enclosure base 110. This embodiment may allow for loading multiple aerial projectiles 102 for continuous looping. Furthermore, visual sensors in the robotic arms may allow the robotic arms to grasp an aerial projectile 102 from midair while the aerial projectile 102 is in continuous looping to allow the arm to return the aerial projectile 102 to the enclosure base 110. The robotic arm may also house the aerial projectile 102 within itself so that it drops them automatically according to automated timing for multiple aerial projectiles 102 to be launched and looped continuously. The robotic arm may also disconnect the runway 104 as an aerial projectile 102 is looping and take over the lifting for one or more loops and then return the runway 104 to the linear lift actuator 138, at which point the robotic arm's hand can express a communication, such as a thumbs up. Once the aerial projectile 102 is at rest along the runway 104 the robotic arm may grasp the ball from the runway 104 and return it to the enclosure base 110.

According to one embodiment, the aerial projectile 102 can be directed by one or more magnetic assemblies that is enclosed in the runway 104 in a worm screw that extends the length of the runway 104, allowing for the magnetic assembly to lift a metal aerial projectile 102 along the runway to launch it from a discharging ramp section 109*b* to be received by a receiving ramp section 109*a*. The magnetic assembly can be energized and deenergized for purposes of directing the aerial projectile 102.

According to one embodiment, the aerial projectile's 102 motion can be directed by magnetic forces according to magnetic coils being placed around the runway 104 at periodic intervals. To launch the aerial projectile 102, the magnetic coils may be activated utilizing silicone-controlled rectifiers in a firing pattern that moves the aerial projectile 102 back and forth along the runway 104 until the aerial projectile 102 has sufficient velocity to leave the discharging ramp section 109*b* and received by the receiving ramp section 109*a*. In this embodiment, the force of one to three magnetic coils along the bottom of the runway 104 may be enough to launch the aerial projectile 102 from the discharging ramp section 109*b* without the need for rocking the aerial projectile 102. External magnetic coils may also be positioned and energized so the aerial projectile 102 would be suspended above the runway 104, following the path of the magnetic energy. The magnetic energy could be directed in a u-shaped trajectory, obviating the need for a runway rail 108.

According to one embodiment utilizing a linear lift actuator 138, the lifting action cannot be a direct 300 pulse wide open lift. The launching of the aerial projectile 102 at the precise location along the runway 104 requires a controlled deceleration as the runway 104 descends slowly to capture the aerial projectile 102 and at the correct location on the runway 104, the motor of the linear lift actuator 138 decelerates along an exponential curve, utilizing the efficiency of a sling shot effect. In other words, the linear lift actuator 138 should be retracting as the aerial projectile 102 makes contact with the runway 104, thereby allowing for a smoother transition as the aerial projectile 102 lands and makes a secure connection before the linear lift actuator 138 re-extends.

According to one embodiment, the need to stop the aerial projectile 102 requires the same precise timing to launch the aerial projectile 102. Once the aerial projectile 102 lands, the linear lift actuator 138 descends at the appropriate time to recapture the aerial projectile 102 along the runway 104. And if the linear lift actuator 138 utilizes an x-axis and y-axis along the runway 104, the runway 104 can be moved in the opposite direction of the aerial projectile's 102 movement to decelerate and stop the aerial projectile's 102 movement.

According to one embodiment, there are provided homing sensors to recalibrate all servo and/or stepper motors. Encoder feedback may also be provided on all servo and/or stepper motors as a safety mechanism and for securing proper operation of the complete automated runway loop 100. The aerial projectile 102 may also be launched using compressed air jets. The automated runway loop 100 may also incorporate a system to feed multiple aerial projectiles 102 to allow the automated runway loop 100 to loop multiple aerial projectiles simultaneously. The vertical axis of actuators may work in conjunction with multiple eye sensors to detect aerial projectile's 102 location along the runway 104 for detecting the height of the aerial projectile on the runway and lift accordingly to launch the aerial projectile out of the discharging ramp section 109*b* to begin the continuous looping process. It will be appreciated by one of ordinary skill in the art that the different embodiments herein may be utilized interchangeably for launching, stopping, and/or continuously looping the aerial projectile 102.

According to one embodiment, the runway 104 may be lifted, extended, or moved along multiple axes through use of servo motors, stepper motors, hydraulic systems, pneumatic systems, or electricity, including on a nano scale.

According to one embodiment, a runway 104 may have a 3 degree toe-in at the top of the runway 104 so that the launching of the aerial projectile 102 out of the discharging ramp section 109*b* is substantially horizontal rather than exclusively vertical. The runway 104 may not need a toe-in angle if the enclosure base 110 has a rotational axis connected to the base of the linear lift actuator 138 that is coupled to the runway 104

According to one embodiment, a stepper motor or servo motor utilizing encoder feedback for positioning is connected to the mounting shaft 136 located beneath the center point of the runway 104. A linear lift actuator 138 or vertical actuator 140 motor can be mounted within the enclosure base 110 to conceal the inner moving parts thereby allowing the runway 104 to sit directly above the enclosure base 110. The runway 104 may have motion sensors within the runway rail 108 or the housing of the runway rail 108 so as to monitor the lifting forces used to launch the ball so as to provide a clear understanding of the launch force needed to properly relaunch the aerial projectile 102. The automated runway loop 100 may also employ lasers to track and locate the aerial projectile 102 as it leaves the discharging ramp section 109*b* of the runway 104 so that the automated runway loop 100 system may perform calculations for capturing or relaunching the aerial projectile 102.

According to one embodiment, the runway 104 can be located in a solid body, such as a cube, block, or triangle, containing two or more holes allowing the aerial projectile 102 to exit one hole and enter another hole while in continuous looping. Similarly, a u-shaped runway 104 may be hollowed out from a piece of wood or other similar solid body, for concealing the body of the automated runway loop 100 inside the block. The u-shaped channel may also be carved in a block or on a post. Similarly, multiple stationary blocks or cubes may be stacked in a pyramid shape, with each block or cube containing a runway 104 as well as multiple holes allowing the aerial projectile 102 to exit one hole and enter another hole while in continuous looping According to one embodiment, the base may also have servo motors that travel along an x-axis or a y-axis to correct for external wind forces when, or example, the automated runway loop is used outdoors. The runway rails 108 may also be removed and the aerial projectile may be directed by magnetic forces along a u-shaped path. Similarly, the u-shaped runway 104 may consist of an enclosed cavity, such as a pipe, for use in regular operation or for use underwater with lighting effects or other decoration. Such enclosed cavity or pipe may be either transparent or opaque.

According to one embodiment, multiple runways 104 may be utilized for looping multiple aerial projectiles 102 at once through use of a rotation axis.

According to one embodiment, the runway 104 may have a knock sensor or decibel measurement device to receive feedback from the aerial projectile 102 landing on the runway rail 108. This arrangement allows the automated runway loop 100 system to monitor the sound to ensure the position or motion of the runway 104 is timed in sync with the position or motion of the aerial projectile 102, thereby ensuring a smooth transition from the airborne aerial projectile 102 to its landing on the runway 104.

According to one embodiment, the automated runway loop 100 may include multiple runways 104 on separate enclosure bases 110 with the ability to move into alignment with other runways 104. Such movement may be accomplished via use of wheels or tank-tracks extending from beneath the enclosure base 110. Sensors may be utilized to measure distances and provide data on the angle of rotation of a runway 104, allowing a specific runway 104 to discharge an aerial projectile 102 for receipt on a separate runway 104.

According to one embodiment, the automated runway loop 100 may employ machine learning to monitor the fluidity of the reception and discharge of aerial projectile 102 to refine the movements. Machine learning may further allow automated runway loop 100 to set a goal or a level of perfection so as to monitor a user's level of focus.

According to one embodiment, the automated runway loop 100 may be mounted onto a gyro mount (preferably in the middle) so that the automated runway loop 100 maintains balance where, for example, it is disturbed or picked up by a user. Similarly, stepper actuator motors may be connected to feet on the corners of the enclosure base 110. Such stepper actuator motors may utilize a digital level to allow the stepper actuator motors to automatically level the automated runway loop 100 on any surface. For example, the digital level may be connected to and in communication with Such functionality is useful where, for example, the automated runway loop 100 is used in a moving vehicle, such as an automobile, train, bus, boat, yacht, or the like. Such functionality is further useful for adjusting the correct toe-in on either side of the runway 104, which would otherwise require correction via a rotation axis connected to the runway 104.

According to one embodiment, the enclosure base 110 may be a box of square or rectangular shape, or alternatively may be of a pyramid shaped. The enclosure base 110 may include interior insulation to dampen to sound of actuators, motors, or other mechanical assemblies. The enclosure base 110 may also contain a fan to cool the circuitry and mechanisms of the automated runway loop 100. Similarly, the enclosure base 110 may be a standing robot-figure holding the runway 104 with a hand that drops aerial projectile into the runway 104 to begin continuous looping.

According to one embodiment, the automated runway loop 100, including the enclosure base 110 and runway 104, is mounted under a floor, with the flooring having at least two holes to permit the aerial projectile to be launched from the discharging ramp section 109*b*, pass through the first hole, enter the second hole, and be received by the receiving ramp section 109*a*. Alternatively, a portion of the ramp may protrude above the floor with the same method of operation.

According to one embodiment, the enclosure base 110 contains an automated leveling system utilizing the feet on the four corners of the enclosure base 110 or runway 104 to level the unit. Automated levelling may be accomplished via stepper motors connected to a digital level that is communication with a central processor and/or electronic control board that controls the one or more stepper motors.

According to one embodiment, a square frame is created using, for example, a 3D printer, that is created with three axes (X, Y, and Z) with an optional rotational axis. Mounting the runway 104 along these four axes gives a user the ability to utilize the rotational axis connected to the runway 104 for purposes of creating a kinetic movement or dancing display with the aerial projectile 102. The aerial projectile 102 can therefore be discharged along a separate trajectory and then recaptured where a runway 104 moves along the three separate axes to position the runway 104 under the desired location for the aerial projectile 102 to be received. This design may allow for a user to separately use the automated device described in U.S. patent application Ser. No. 16/449,332, where the automated runway loop 100 would mirror the user's movements. Such design would further allow the mirroring and monitoring a user's hand movements to determine the stability and location of the runway 104 utilizing less movement to permit efficient reception and discharging of the aerial projectile 102 from the runway. Furthermore, this would allow for calibration of the sensors in U.S. patent application Ser. No. 16/449,332.

According to one embodiment, the enclosure base 110 contains a bed actuator with two axes. A vertical linear actuator is then placed on the bed actuator to allow three axis movement in the enclosure base 110.

Figure 2:
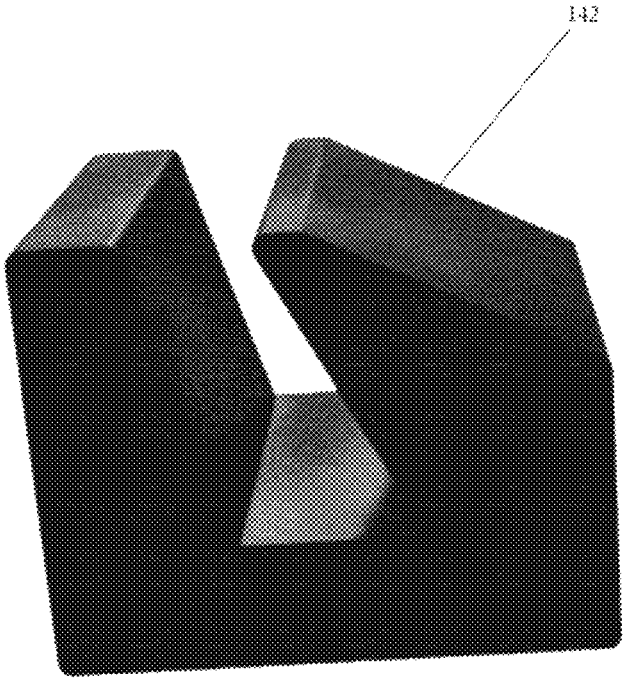
FIG. 2 is an elevational view of a dampening grommet in accordance with one embodiment.
Figure 3:
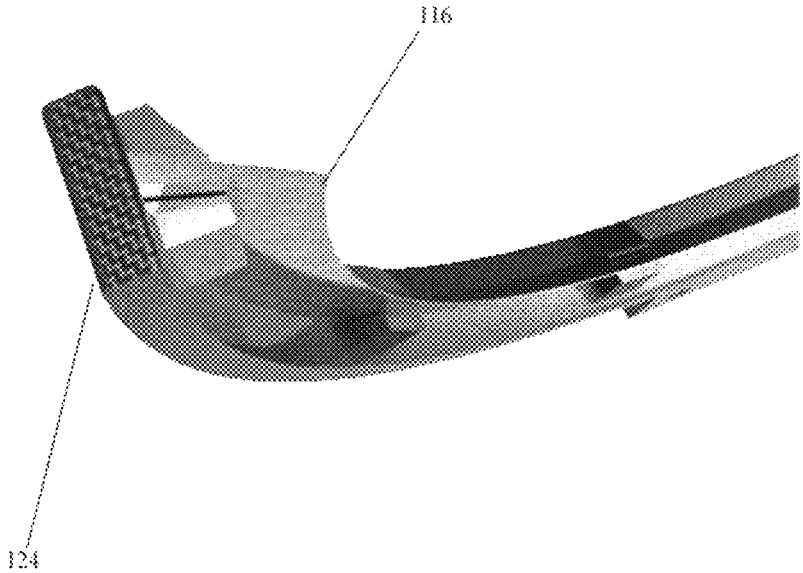
FIG. 3 is an isolated view of a runway rail in accordance with one embodiment.
Figure 4:
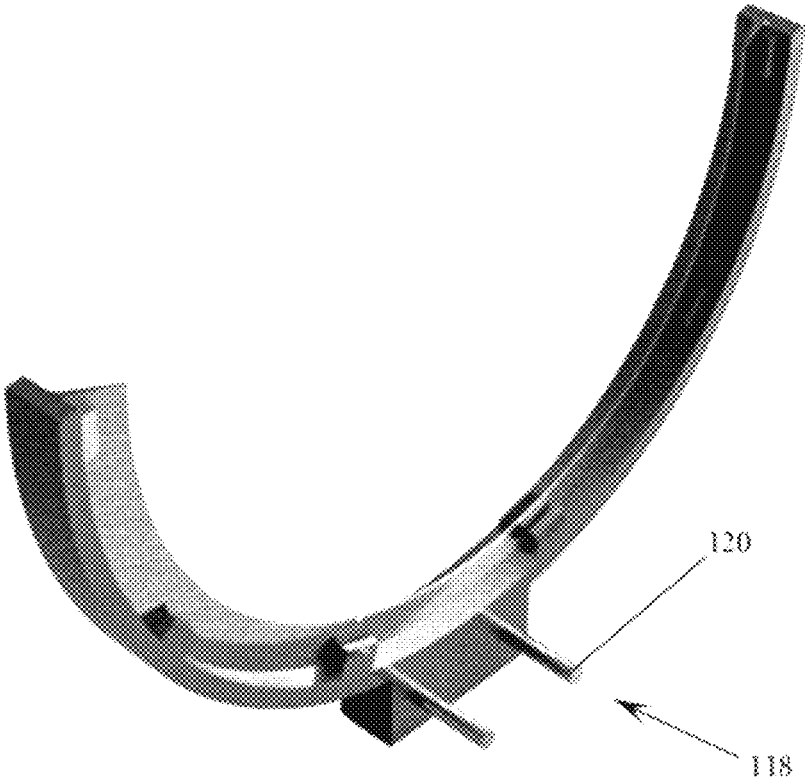
FIG. 4 is a perspective view of a first knife-edge rail component in accordance with one embodiment.
Figure 5:
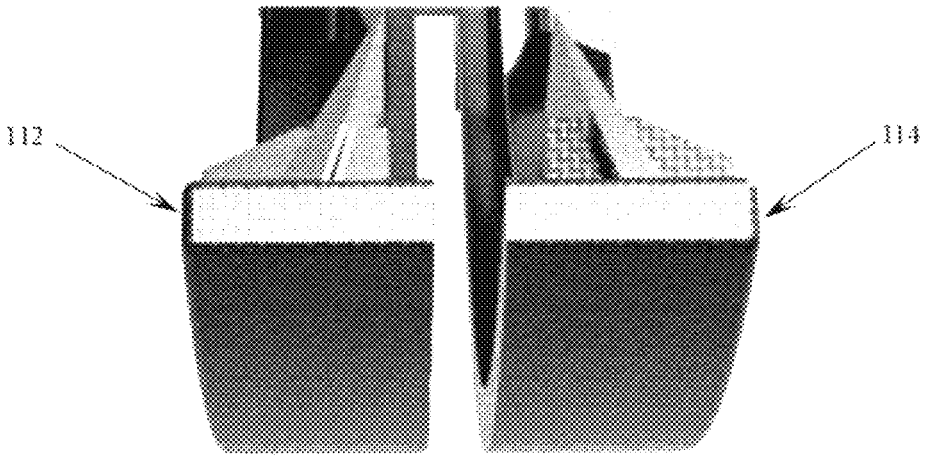
FIG. 5 is an isolated elevational view of a first knife-edge rail component and a second knife-edge rail component in accordance with one embodiment.
Figure 6:
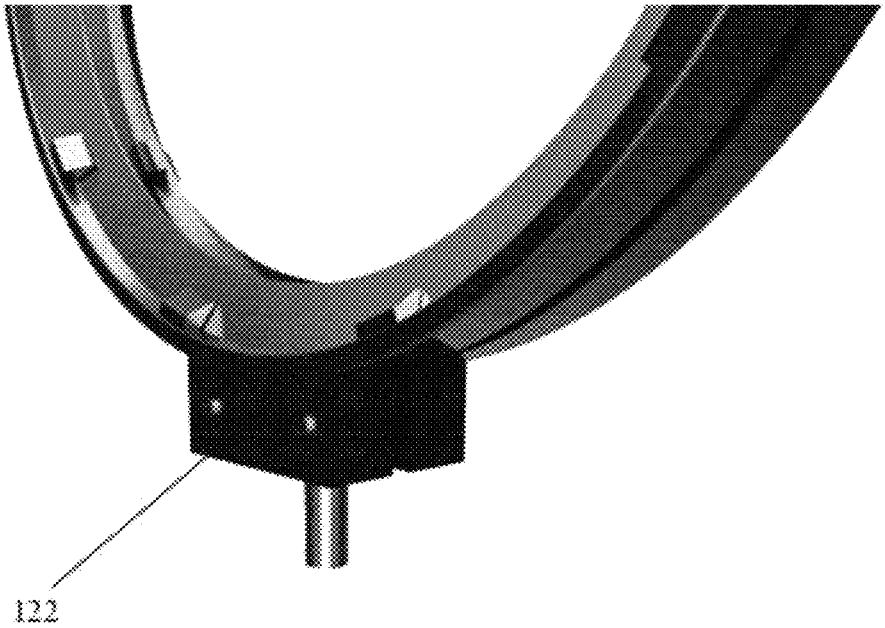
FIG. 6 is an isolated perspective view of a runway in accordance with one embodiment.
Figure 7:
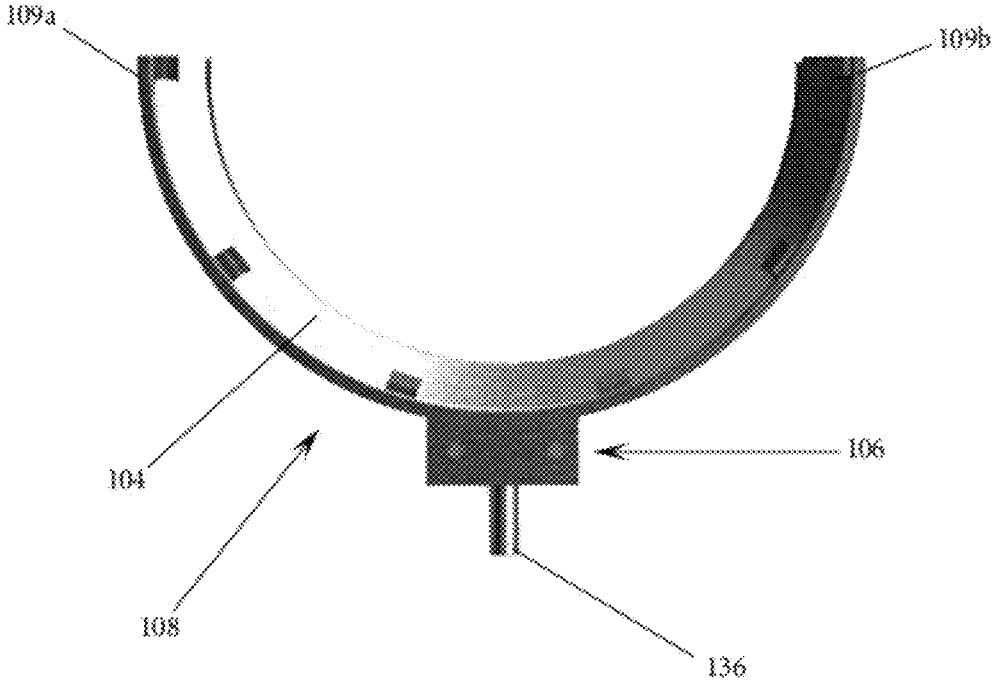
FIG. 7 is a profile view of a runway rail in accordance with one embodiment.

Referring now to FIG. 2, according to one embodiment, the invention may be utilized as a kinetic art piece. Furthermore, dampening grommets 142 may be used in conjunction with the runway 104 to quiet the sound of an aerial projectile rolling over a runway rail 108 made from steel or other similar material. Dampening grommets 142 may be composed of rubber, foam, or similar shock-absorbing materials and may be attached at multiple locations along runway 108 to prevent and/or reduce vibration along the runway 108.

According to one embodiment, the automated runway loop 100 has the ability to loop a nano-sphere. For example, the automated runway loop would require a correctly-timed pulse of energy so that a nano-sphere is launched out an over to be recaptured and then relaunched by using a small electromagnetic pulse to the upward movement of the runway 104.

According to one embodiment, the automated runway loop 100 may include a runway of at least a radius or diameter of five feet, providing the ability to launch an aerial projectile 102 from ten to over one hundred vertical feet. This embodiment requires a self-correcting base utilizing laser sightings to allow for the self-correcting base to realign itself with the aerial projectile's 102 trajectory where, for example, wind may affect the trajectory of the aerial projectile 102.

According to one embodiment, when the automated runway loop 100 is utilized as kinetic art, a safety shield would be attached along the perimeter of the automated runway loop 100 to prevent the aerial projectile 102 from injuring someone or something if the automated runway loop 100 malfunctions or the aerial projectile's 102 trajectory is disturbed.

According to one embodiment, the automated runway loop 100 contains a double safety control system to ensure a safe capture of the aerial projectile 102 in case one system fails.

According to one embodiment, the automated runway loop 100 utilizes proportional hydraulics to launch the aerial projectile 102, allowing the aerial projectile to be launched to heights of at least one hundred vertical feet. A moving base may be utilized to permit the automated runway loop 100 to compensate for the effect of wind on the aerial projectile 102, thus allowing the aerial projectile 102 to be caught smoothly. Similarly, a linear lift actuator 138, vertical actuator 140, rotation actuator 134, or other such linear actuator may be connected to the runway 104 to adjust the enclosure base 110 and/or runway 104 to allow for safe and effective discharge or receipt of the aerial projectile 102.

According to one embodiment, to recapture the aerial projectile 102 from either great heights or heights as low as one foot, the automated runway loop 100 utilizes a rotary axis on the runway 104 to discharge the aerial projectile 102 vertically. As the aerial projectile 102 is received by the runway 104, the aerial projectile 102 may rock back and forth until it comes to rest at the bottom of the runway 104. For example, upon the runway's 104 receipt of the aerial projectile 102, the rotation actuator 134, linear lift actuator 138, and/or vertical actuator 140 may cease movement, thus ceasing the force that would allow the aerial projectile 102 to proceed in a continuous loop.

Figure 20:
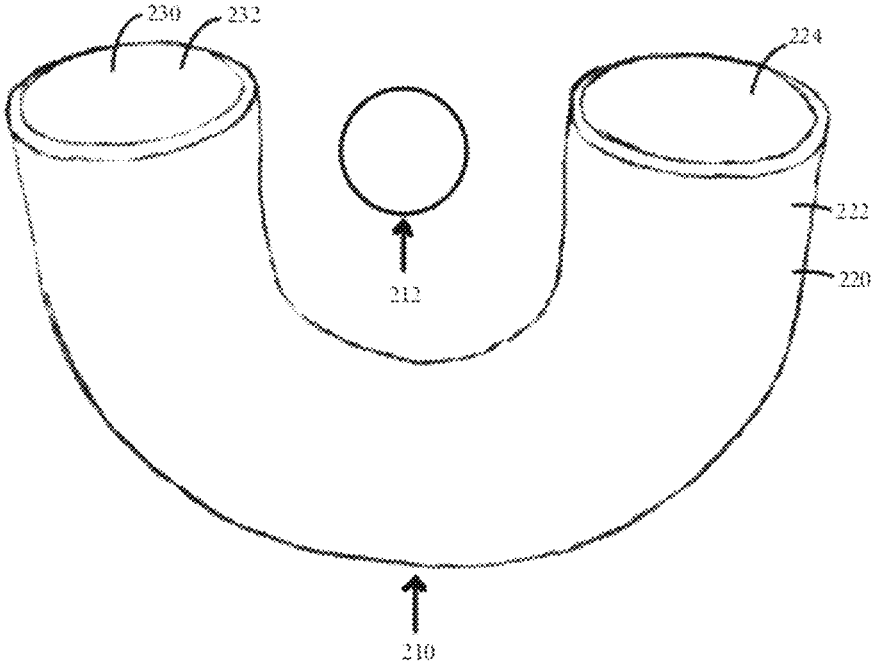
FIG. 20 is a profile view of an electronic training game in accordance with one embodiment.
Figure 21:
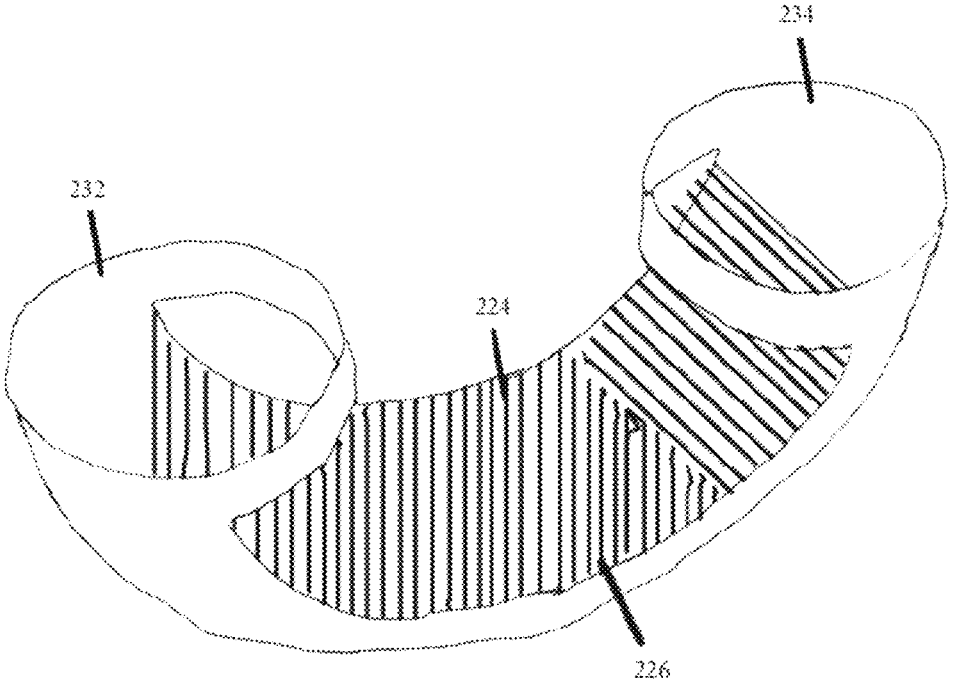
FIG. 21 is a top profile view of an electronic training game in partial cross section in accordance with one embodiment.

With reference to FIG. 20, and in one embodiment of the invention, game 210 is provided and comprises a cylindrical shaped conduit 220 having exterior walls 222, interior walls 224, and an aperture therethrough 230. With reference to FIG. 21, ribs 226 are disposed about interior walls 224, and adapted to guide at least one aerial projectile through said aperture 230 within interior walls 224. In a specific embodiment of the invention ribs 226 are adapted to create a sound which is indicative of a presence within the interior walls 224. Ribs 226 may not be employed in specific embodiments wherein sensors are used. Training bar 250 has sensors in certain embodiments.

Conduit 220 has an inner diameter that is adapted to accept and allow to freely move therethrough a desired aerial projectile 212. Projectile 212 may be any desired projectile capable of traveling through aperture 230. In one embodiment, projectile 212 is a ball. Interior walls 224 may be adapted to accept the user's chosen projectile 212.

In one embodiment of the invention, the inner diameter of conduit 220 is in the range of about three inches. As used herein, three inches may include, but is not limited to 2.9 to 3.1 inches. Conduit 220 may have any outer diameter that allows the objects of the invention to be achieved, i.e. free movement of an aerial projectile through the runway and flexibility of conduit 220 to achieve such movement. It should be noted that if conduit 220 has walls that are too thick, flexibility is compromised and these objects can't be properly achieved. In one exemplary embodiment, conduit 220 has an outer diameter of about three inches. Conduit 220 may be of various lengths. In one embodiment, conduit 220 is about 22 inches in length. The minimum wall thickness is about 0.011 inches. As used herein "about" means having a standard deviation of ±0.56.

During use, a user holds conduit 220 with both hands so that access point 232 and access point 234 are upright and projectile 212 is in the center of the conduit 220. The user then starts projectile 212 moving back and forth by moving the conduit 220 to the left. As projectile 212 starts to roll a few inches inside conduit 220, the user moves conduit 220 to the right, which creates momentum on projectile 212 so that it will travel farther up the opposite side of conduit 220. The user repeats the above steps until projectile 212 leaves conduit 220 through access point 232. When projectile 212 projects out of conduit 220, the user captures it in access point 234, only to release it again. Projectile 212 can be caught with access point 232, where it was released, by reversing the direction of movement of conduit 220 from a clockwise to a counterclockwise direction. Timing is a great factor in continuous play. When projectile makes contact with conduit 220, the user drops the conduit 220 down to allow for a soft landing therein. As projectile 212 reaches the middle of conduit 220, the user pumps the hands by dropping, then lifting, as projectile 212 rolls into the center, giving it more momentum to leave conduit 220.

Any aerial projectile 212, also referred to herein as projectile 212, may be placed within the interior walls of cylindrical conduit 220. As described, a user must manipulate their bodies, including using their hands to manipulate the shape an angle of conduit 220, to toss projectile 220 through a first access point 232 on one end of conduit 220 to a second access point 234 on the other end of conduit 220 creating continuous loops of projectile through access point 232 and access point 2234. To facilitate such movement of projectile 212 through therethrough, conduit 220 must be manipulated. As such, conduit 220 is made of a flexible material that allows its ends to be moved toward or away from another and its walls to be twisted in specific embodiments. In fact, the conduit 220 shape used to commence using the game 210 is different than the shape necessary for continuous use. Conduit 220 is U-Shaped in a specific embodiment of the invention, as illustrated in FIGS. 20 and 21, but may be of any shape that achieves the objects of the invention. "U-Shaped" means that access point 232 and access point 234 are generally parallel to each other. It should be noted that projectile 212 can be launched into or out of access point 232 or access point 234.

It should be understood, however, that various embodiments not described herein do not employ a conduit 220 that is made of a flexible device. It is possible for some users to successfully move projectile 212 through conduit 220 without twisting or moving runway 220, employing heightened skill and bodily movement.

A means 236 for sensing and measuring aerial projectile 212 movement is in electronic communication with at least one of conduit 220 or projectile 212. As used herein, electronic communication means being connected in a manner that allows electronically stored game information to pass therebetween. A central processing unit (not shown) is adapted to calculate and communicate game information with at least one player in electronic communication with means 236 for sensing and measuring aerial projectile 212 movement. Game information that is transferred between means 236 and the central processing unit ("CPU") includes, but is not limited to loop total count, acceleration, catch time, tricks attempts, trick completion, direction (via axis as it relates to a current user), game commencement, game termination, game restarting, time, tube state, and any other information to be displayed to a user by the central processing unit. It will be understood by those of skill in the art that measuring movements via the x, y and z axis allows a user's focus and skill to be monitored and communicated to the user.

Figure 22:
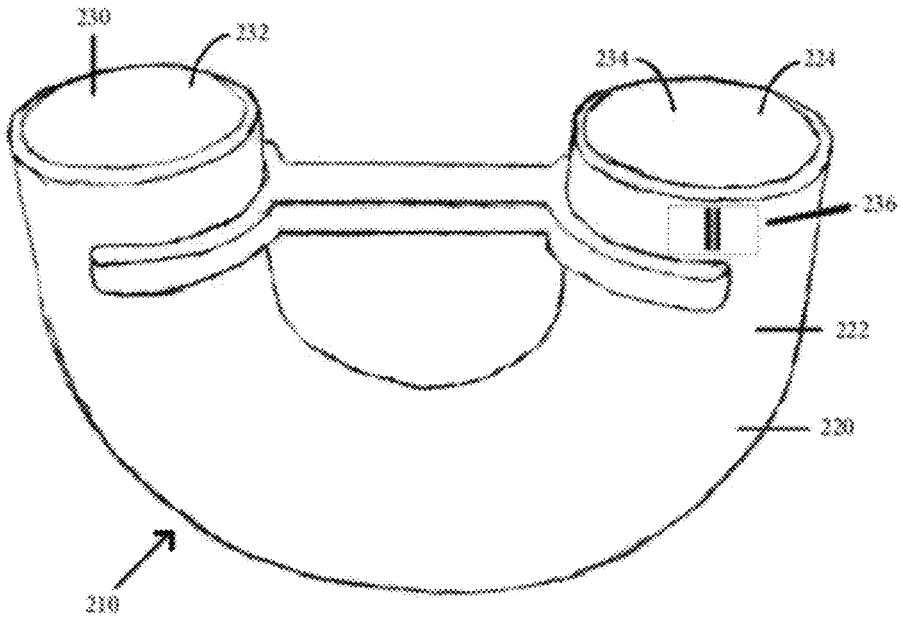
FIG. 22 is a front perspective view of an electronic training game in accordance with one embodiment.
Figure 23:
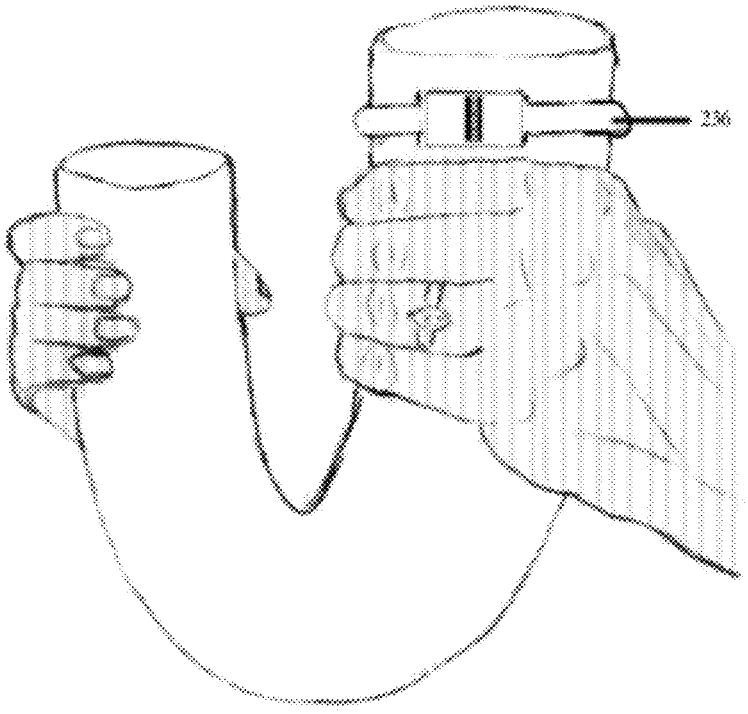
FIG. 23 is a perspective view of an electronic training game in accordance with one embodiment.
Figure 24:
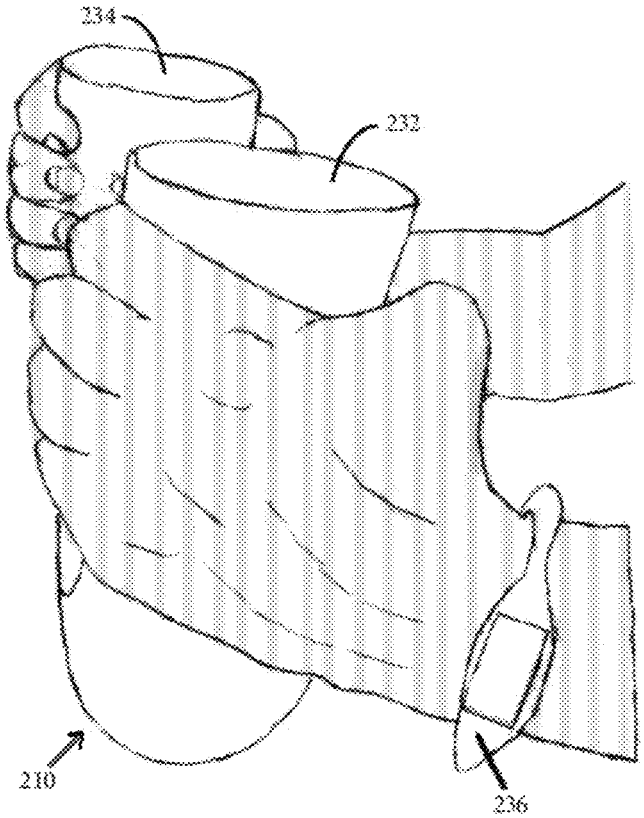
FIG. 24 is a side profile view of an electronic training game in accordance with one embodiment.
Figure 25:
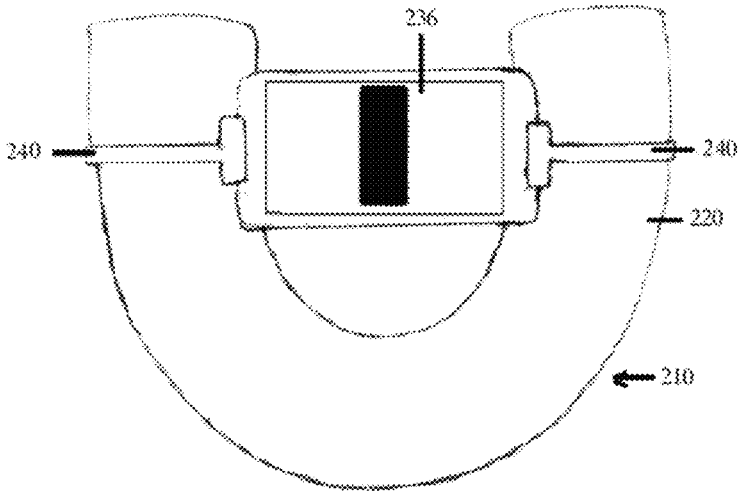
FIG. 25 is a front profile view of an electronic training game in accordance with one embodiment.

As illustrated in FIGS. 22 and 23, means 236 may be directly or indirectly attached to exterior walls 222 or interior walls 224 (not illustrated). However, it is not necessary that means 236 be in physical communication with conduit 220 or projectile 212. With reference to FIG. 24 means 236 may be attached to a user's body via a wristband or glove, with reference to FIG. 26, bar 250 (described in more detail below) may be removably attached via a secondary device to conduit 220, or within a handheld personal electronic device. As used herein, "personal electronic device" includes but is not limited to, with reference to FIGS. 24 and 25, an electronic tablet, smart phone (IOS, Android, etc.), computer, cell phone, electronic glove, and an electronic wristband.

Means 236 may also be housed within or attached to projectile 212. In this particular embodiment of the invention (not illustrated in the Figures), means 236 lies within projectile 212 and comprises a self-generating coil adapted for rotational movement. When the coil is spun due to spinning of the projectile 212 as it travels through access point 232 and access point 234, energy is created, thereby reducing or eliminating the need for a power source. In even more specific embodiments wherein means 236 is within projectile 212, a gyro sensor is included to determine when use has ended, e.g. when conduit 220 is more than 90 degrees from its play position. In the specific embodiment of the invention wherein means 236 is internally housed within projectile 212, means 236 is adapted to determine the location, i.e. on the ground, of projectile 212.

It should be understood by those of skill in the art that means 236 may communicate with other means 236 incorporated into other devices, allowing communication between multiple electronically communicating devices and play between two distinct games 210. Any device capable of electronically communicating with means 236 may be connected including, respiration monitors, heart rate monitors, brain wave monitors, and the like. Likewise, artificial intelligence technology may be used that enables the user to receive guidance and communications from a third party like a coach or teacher. In that specific embodiment, a teacher or other third-party monitors use remotely and provides feedback to improve play or use.

Means 236 for sensing and measuring aerial projectile 212 movement comprises a sensor board in specific embodiments. One skilled in the art is well adapted to choose any appropriate sensor board. In specific embodiments, the sensor board comprises at least one of a microphone, microcontroller, controller, Bluetooth technology, WIFI technology, accelerometer, gyro sensor, barometer, and power source, and may be any known power source.

The CPU of the invention is adapted to communicate any game information to a user, including but not limited to state information, the percentage within certain zones or areas of conduit 220. CPU is also adapted to transmit the game information to all others in electronic communication therewith, including databases and websites. Game information may be presented in known matters, including graphs, charts, illustrations and demonstrations.

Figure 27:
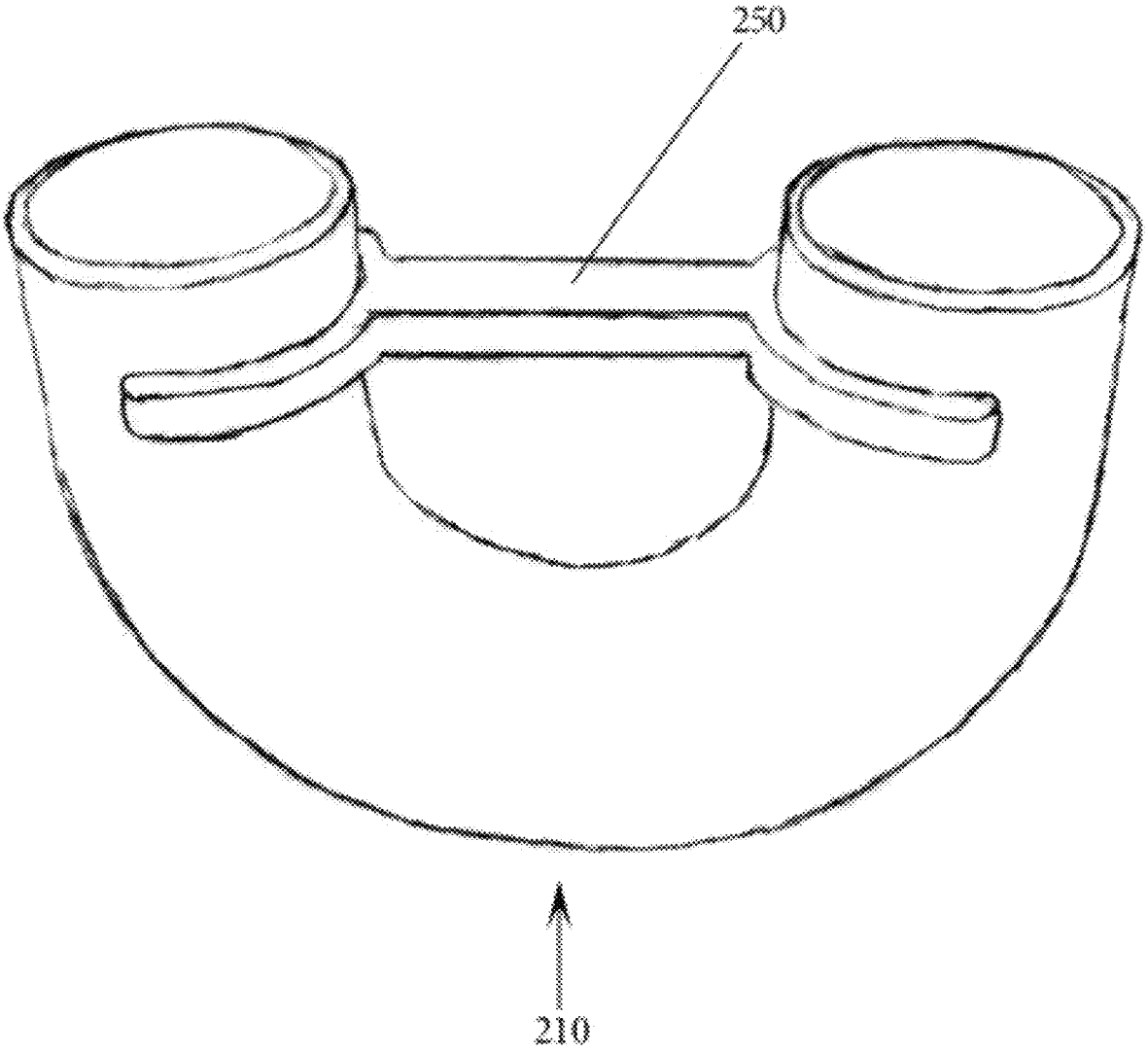
FIG. 27 is a front perspective view of an electronic training game in accordance with one embodiment.

With reference to FIG. 27, CPU is adapted to calculate, interpret and communicate state information to the user, including but not limited to X, Y, and Z axis information, which in turn allows the CPU to communicate at least one of the following to a user: count, out of/into conduit 220 count, in play, lift, drop, in conduit, out of play, launching projectile 212 out of conduit 220, and zone information. The CPU is adapted to communicate sound to the user in specific embodiments of the invention.

In an example, once a user pushes a "PREPARE THE ZONE" button, or the like, the "INITIALIZATION" screen 258 will appear, this will have a Ready! Set! Play! That will pop up on the "INITIALIZATION" screen and at this time you need to hold the game still, not moving it, while the programming measures the accelerometer, gyro and microphone to establish a base line measurement to begin play. Once the "Ready! Set! Play!" goes away, the "COUNTING" screen will be ready for the player to begin their attempt at getting the ball or other projectile 212, out to complete their first loop. "END GAME" and "BACK" buttons may be utilized. Once the projectile 212 is dropped or stalls in conduit 220 and the application ends the game users may be offered the opportunity to post their scores electronically, game results, or zone information.

The "zone" is a measurement of the players focus, only small movements up and down on the Z axis illustrated in FIG. 27. "Middle zone" is where the player is moving outside the zone parameters, chasing the ball to catch it. The embodiments described herein are not limited by these descriptions, which are for exemplary purposes only.

CPU may be adapted to allow any parameter or game information collected to be calculated and communicated to a user based upon preference. In a specific embodiment, CPU is adapted to monitor game information and parameters using pre-defined indexes to determine fraud.

Figure 26:
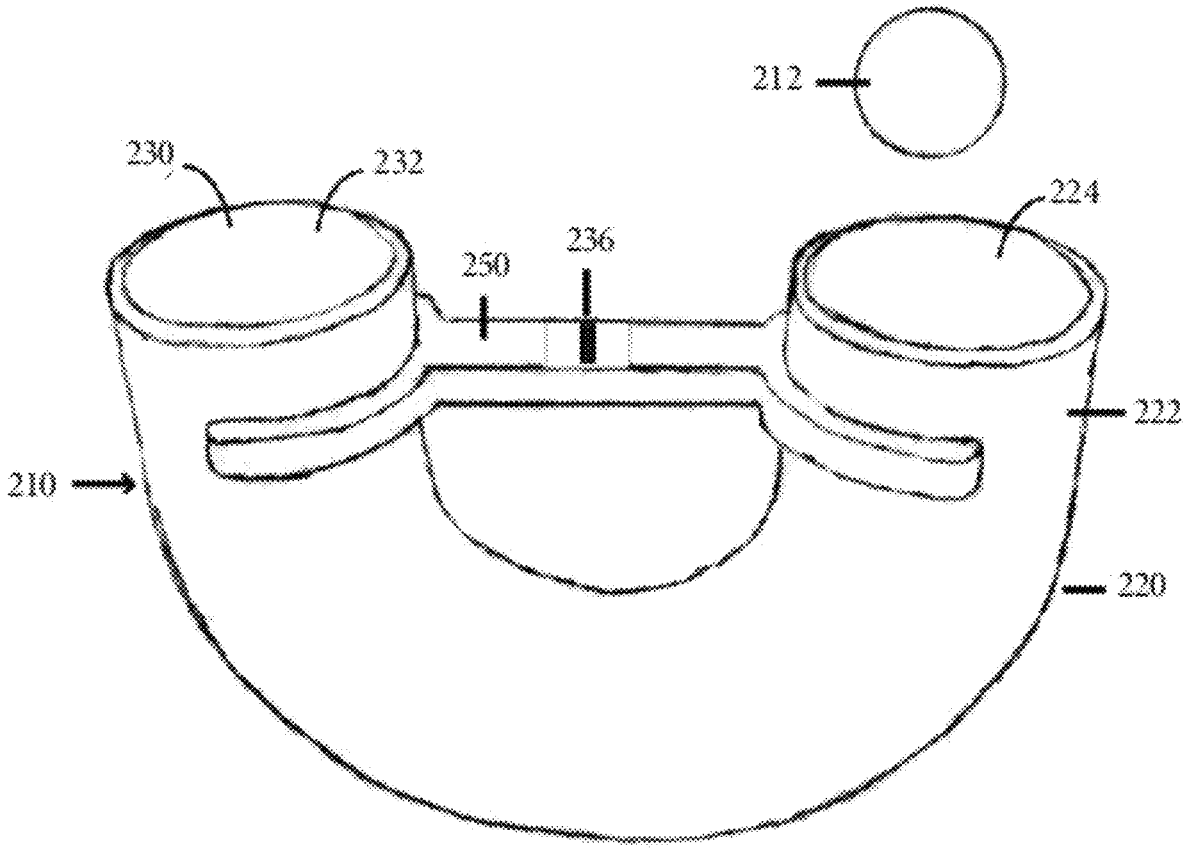
FIG. 26 is a front perspective view of an electronic training game in accordance with one embodiment.

In a specific embodiment, and with reference to FIGS. 22 and 26, game 210 further comprises stabilization bar 250, removably attached to exterior walls 222 of conduit 220. Bar 250 is removably disposed between exterior wall 222 on opposing ends of conduit 220 such that access point 232 and access point 234 are generally level to one another, creating the U-Shaped embodiment illustrated in the Figures. Bar 250 is generally employed for user training and is well suited to train athletes. It should be noted that access points 232 and access point 234 are not perfectly level. Bar 250 comprises any means for removably attaching itself to conduit 220, including but not limited to an integrated hook.

Bar 250, in specific embodiments also includes an integrated barometer (not illustrated in the Figures).

In specific embodiments of the invention, bar 250 is adapted to communicate game information to a user. In an exemplary specific embodiment, bar 250 comprises at least three light emitting diodes, e.g. red, green and yellow, which show the state of zone for the user to easily monitor the game without losing focus on the projectile.

In yet another specific embodiment of the invention, bar 250 comprises an arm, which protrudes away from the access points 232 and 234. The arm is hollow and includes a small cylinder protruding from the bottom. The cylinder may be of any size and in one embodiment is ⅛ inch long and ⅛ inches in diameter. The cylinder could be inserted into a central portion of exterior wall 2222 about equidistance between the access points 232 and 234. In specific embodiments wherein a barometer is employed within bar 250, the presence of projectile 212 within interior walls 224 could be measured and sensed based pressure changes within aperture 230. In similar embodiments, at least one of a magnetometer or gyro is used to measure pressure inside aperture 230 as projectile 212 enters and exists.

Projectile 212 may be made of any material that meets the various objects of the invention. As such, projectile 212 must be lightweight and of a size that is capable for aerial propulsion between access point 232 and access point 233. In one embodiment of the invention, projectile 212 is made of phenolic. In another embodiment, projectile 212 is rubber and has a matte finish, which prevents projectile 212 from getting lodged within aperture 230.

Projectile 212 may include or be in communication with additional elements in certain embodiments, including, but not limited to at least one camera, video screen and light emitting diodes. In a specific embodiment of the invention, projectile 212 comprises a video camera that is adapted to camouflage itself from photographing back side of the ball views and placing the view on the players side of the ball so projectile 212 is not visible to viewers on the other side.

In accordance with one embodiment, a training game may include: a cylindrical conduit having exterior walls and interior walls, the interior walls forming an aperture therethrough that is adapted and sized to accept at least one aerial projectile therethrough, the conduit having a first access point and a second access point; ribs disposed about the interior walls of said conduit, said ribs adapted to guide the at least one aerial projectile through said aperture; a means for sensing and measuring aerial projectile movement electronic communication with at least one of said conduit or said projectile; and a central processing unit adapted to calculate and communicate game information with at least one player in electronic communication with said means for sensing and measuring aerial projectile movement. The game may also include means for sensing and measuring aerial projectile movement that includes a sensor board. The sensor board may include at least one or more of a microphone, Bluetooth technology, WIFI technology, accelerometer, gyro sensor, and/or power source.

According to one embodiment, the game conduit may be U-shaped and made of a flexible material. The game may also include a stabilizing bar that is removably attached to the exterior walls of the conduit. The means for sensing and measuring an aerial projectile may be in direct communication with at least one of the exterior walls of the conduit and may include a bar that is removably attached to the exterior walls of the conduit and may also include a remote electronic device and a handheld computer.

According to one embodiment, the means for sensing and measuring an aerial projectile is specifically adapted to measure and sense the exit of the aerial projective from the first access point into the second access point.

According to one embodiment of the game, the central processing unit is in communication with at least one personal electronic device.

According to one embodiment, the means for sensing and measuring an aerial projectile is further specifically adapted to send information to the central processing unit when the aerial projectile does not enter or exit the first access point or the second access point within a pre-determined length of time.

According to one embodiment, the means for sensing and measuring an aerial projectile is specifically adapted to measure conduit states and aerial projectile states. The conduit states may include at least one of a z-axis, x-axis, y-axis, and/or sound. The aerial projectile state may include at least one of: a count, out of conduit, in conduit, in play, out of play, launch, zone, middle zone, and no zone.

According to one embodiment, the electronic communication used may be at least one of Bluetooth technology or WIFI technology. The aerial projectile may be a ball. The conduit may be u-shaped and may be made of plastic. In one embodiment, the inner diameter of the conduit may be about three inches. In one embodiment, the length of the conduit may be about 22 inches.

According to one embodiment, the means for sensing and measuring aerial projectile movement is attached to at least one of said aerial projectile, a wrist band, and/or a glove. The means for sensing and measuring aerial projectile movement may be further adapted to sense at least one of: user respiration, user heart rate, and user brain waves.

According to one embodiment, the training game includes: a U-shaped cylindrical conduit having a first end and a second end, the conduit having exterior walls and interior walls, the interior walls forming an aperture therethrough, the aperture adapted and sized to accept at least one ball therethrough, the conduit having a first access point and a second access point, and the conduit being made of a flexible material; ribs disposed about the interior walls of the conduit, the ribs adapted to guide the at least one ball through the aperture, the ribs further adapted to create a sound as at least one ball travels through the aperture; a bar disposed between and attached to a first end of the conduit and a second end of the conduit, a means for sensing and measuring ball movement attached to the bar; and a computer including a central processing unit adapted to calculate and communicate game information with at least one player in electronic communication with the means for sensing ball movement.

According to one embodiment, the game is a U-shaped, hollow cylindrical conduit adapted and sized to accept at least one ball therethrough, with ribs disposed about the interior walls thereof, a means for sensing and measuring ball movement and a central processing unit adapted to calculate and communicate game information electronically connected thereto.

While the present invention has been shown and described in accordance with several preferred and practical embodiments, it is recognized that departures from the instant disclosure are contemplated within the spirit and scope of the present invention.

What is claimed is:

1. An automated runway loop for an aerial projectile, the automated runway loop comprising:

a u-shaped runway, the runway having a bottom surface and a first end and a second end, the runway defining a path between the first end and the second end;

the runway configured to support the aerial projectile, wherein the first end is configured for discharge of the aerial projectile and the second end is configured for receipt of the aerial projectile;

a runway support attached to or integrally formed with the bottom surface of the runway; the runway support attached to or integrally formed with a motor, the motor capable of extending and retracting the runway support along an axis;

at least one sensor positioned along the runway, the at least one sensor being configured to provide at least one output indicative of at least one parameter of the aerial projectile;

a computer comprising a bus connected to a processor, an input device, a data storage device, an internal storage device, and an output device, wherein the computer is in operable communication with the motor and with the plurality of sensors;

the computer being configured to control energization of the motor based at least in part on an indicated parameter of the aerial projectile; wherein the energization of the motor causes the aerial projectile to be discharged from the first end of the runway and to be received at the second end of the runway for continuous looping of the aerial projectile.

2. The automated runway loop as recited in claim 1 wherein the parameter is velocity.

3. The automated runway loop as recited in claim 1 wherein the parameter is acceleration.

4. The automated runway loop as recited in claim 1 further comprising a launch platform positioned above the second end of the runway, the launch platform having an aperture sized for selective passage therethrough of the aerial projectile.

5. The automated runway loop as recited in claim 4, wherein the launch platform is configured for selective engagement in a first position or selective engagement in a second position;

wherein in the first position, the aperture is sufficiently open to permit passage of the aerial projectile therethrough;

wherein in the second position, the aperture is sufficiently occluded to prevent passage of the aerial projectile therethrough.

6. The automated runway loop as recited in claim 1, wherein the runway comprises two parallel rails.

7. The automated runway loop as recited in claim 6, wherein each of the two parallel rails has a knife-edge.

8. The automated runway loop as recited in claim 1, further comprising a plurality of dampening grommets attached to or integrated with the runway.

9. The automated runway loop as recited in claim 1, wherein the axis is a vertical axis.

10. An automated runway loop for an aerial projectile, the automated runway loop comprising:

a u-shaped runway, the runway having a bottom surface and a first end and a second end, the runway defining a path between the first end and the second end;

the runway configured to support the aerial projectile, wherein the first end is configured for discharge of the aerial projectile and the second end is configured for receipt of the aerial projectile;

a runway support attached to or integrally formed with the bottom surface of the runway; the runway support attached to or integrally formed with a motor, the motor capable of extending and retracting the runway support along an axis;

at least one sensor positioned along the runway, the at least one sensor being configured to provide at least one output indicative of detection of the aerial projectile;

a computer comprising a bus connected to a processor, an input device, a data storage device, an internal storage device, and an output device, wherein the computer is in operable communication with the motor and with the plurality of sensors;

the computer being configured to control energization of the motor based on a time delay triggered by the detection of the aerial projectile, wherein the energization of the motor causes the aerial projectile to be discharged from the first end of the runway and to be received at the second end of the runway for continuous looping of the aerial projectile.

11. The automated runway loop as recited in claim 10 further comprising a launch platform positioned above the second end of the runway, the launch platform having an aperture sized for selective passage therethrough of the aerial projectile.

12. The automated runway loop as recited in claim 11, wherein the launch platform is configured for selective engagement in a first position or selective engagement in a second position;

wherein in the first position, the aperture is sufficiently open to permit passage of the aerial projectile therethrough;

wherein in the second position, the aperture is sufficiently occluded to prevent passage of the aerial projectile therethrough.

13. The automated runway loop as recited in claim 10, wherein the runway comprises two parallel rails.

14. The automated runway loop as recited in claim 13, wherein each of the two parallel rails has a knife-edge.

15. The automated runway loop as recited in claim 10, further comprising a plurality of dampening grommets attached to or integrated with the runway.

16. The automated runway loop as recited in claim 10, wherein the axis is a vertical axis.

17. A method of looping an aerial projectile on a u-shaped automated runway loop, the runway loop having a first end and a second end and a bottom and sensors and configured for receiving the aerial projectile, the bottom mounted to a motor for applying force to the bottom, the method comprising:

receiving the aerial projectile at the second end of the runway loop;

sensing a parameter of the aerial projectile;

driving the runway loop, with the motor, with a force sufficient to discharge the aerial projectile from the first end and to receive the aerial projectile at the second end in response to the sensed parameter.

18. The method of claim 17, wherein the parameter is velocity.

19. The method of claim 17, wherein the parameter is acceleration.

20. The method of claim 17, wherein the motor drives the runway along a vertical axis.

* * * * *